US008306828B2

(12) United States Patent
Nakamura et al.

(10) Patent No.: US 8,306,828 B2
(45) Date of Patent: Nov. 6, 2012

(54) METHOD AND APPARATUS FOR AUDIO SIGNAL EXPANSION AND COMPRESSION

(75) Inventors: Osamu Nakamura, Saitama (JP); Mototsugu Abe, Kanagawa (JP); Masayuki Nishiguchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 1281 days.

(21) Appl. No.: 11/747,029

(22) Filed: May 10, 2007

(65) Prior Publication Data

US 2007/0269056 A1 Nov. 22, 2007

(30) Foreign Application Priority Data

May 15, 2006 (JP) ..... 2006-135545

(51) Int. Cl.
*G10L 21/00* (2006.01)

(52) U.S. Cl. ..... 704/503; 704/500; 704/278; 704/272

(58) Field of Classification Search ..... 704/503, 704/500, 278, 272
See application file for complete search history.

(56) References Cited

U.S. PATENT DOCUMENTS

| | | | | |
|---|---|---|---|---|
| 6,232,540 | B1 * | 5/2001 | Kondo | 84/612 |
| 6,519,567 | B1 * | 2/2003 | Fujii | 704/503 |
| 2002/0169599 | A1 * | 11/2002 | Suzuki | 704/200.1 |
| 2004/0015345 | A1 * | 1/2004 | Megeid et al. | 704/207 |
| 2006/0149535 | A1 * | 7/2006 | Choi et al. | 704/207 |
| 2007/0191976 | A1 * | 8/2007 | Ruokangas et al. | 700/94 |
| 2008/0097752 | A1 * | 4/2008 | Nakamura et al. | 704/211 |
| 2008/0285938 | A1 * | 11/2008 | Nakamura | 386/52 |

FOREIGN PATENT DOCUMENTS

| | | |
|---|---|---|
| JP | 63-131199 | 6/1988 |
| JP | 01-238698 | 9/1989 |
| JP | 2005-266571 | 9/2005 |
| JP | 2006-38956 | 2/2006 |
| JP | 09-062298 | 8/2012 |

OTHER PUBLICATIONS

N. Morita et al., "Time-Scale Modification Algorithm for Speech by Use of Pointer Interval Control Overlap and Add (PICOLA) and its Evaluation", Proceeding of National Meeting of the Acoustic Society of Japan, (1986), pp. 149-150.

Notification of Reasons for Refusal, issued May 25, 2011, with English language translation from the Japanese Patent Office in corresponding Japanese Patent Application No. 2006-135545.

Japanese Patent Application No. 2006-135545 issued by the Japan Patent Office on May 22, 2012 (3 pages).

* cited by examiner

*Primary Examiner* — Qi Han
(74) *Attorney, Agent, or Firm* — Finnegan, Henderson, Farabow, Garrett & Dunner, L.L.P.

(57) ABSTRACT

An audio signal expansion and compression method for expanding and compressing an audio signal in a time domain, includes the steps of setting an initial value of a signal comparison length of a first comparison interval and a second comparison interval, used for detection of two similar waveforms in the audio signal, equal to or larger than a minimum waveform detection length, determining an interval length of the two similar waveforms while changing a shift amount of the first comparison interval and the second comparison interval so that the shift amount does not exceed the signal comparison length, and expanding or compressing the audio signal in the time domain on the basis of the interval length of the two similar waveforms.

16 Claims, 25 Drawing Sheets

-- PRIOR ART --
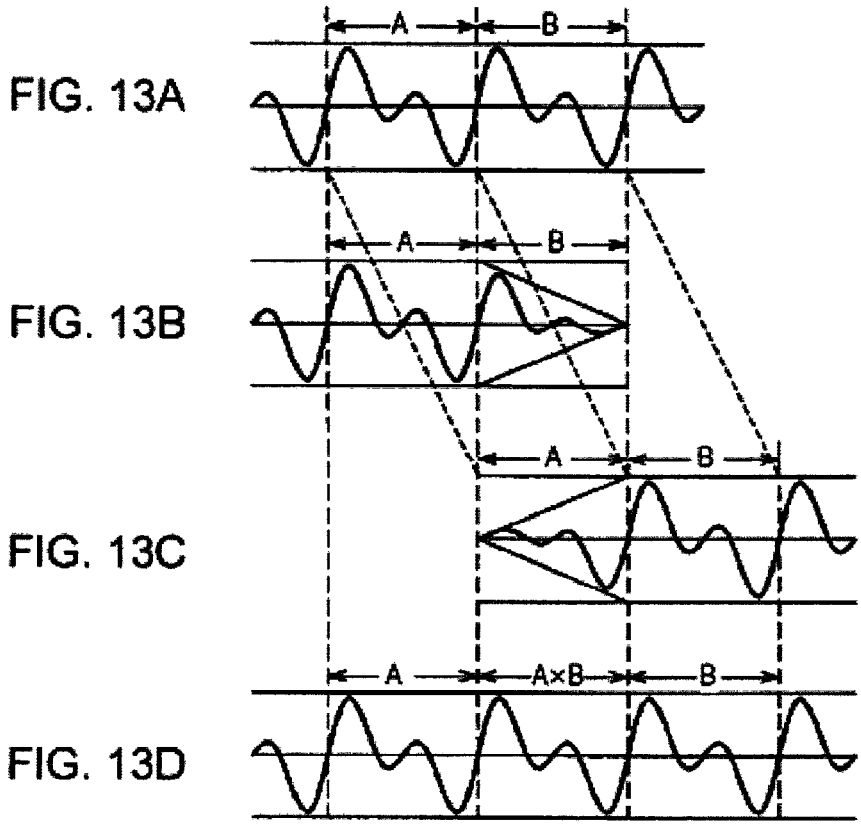

-- PRIOR ART --

-- PRIOR ART --

-- PRIOR ART --
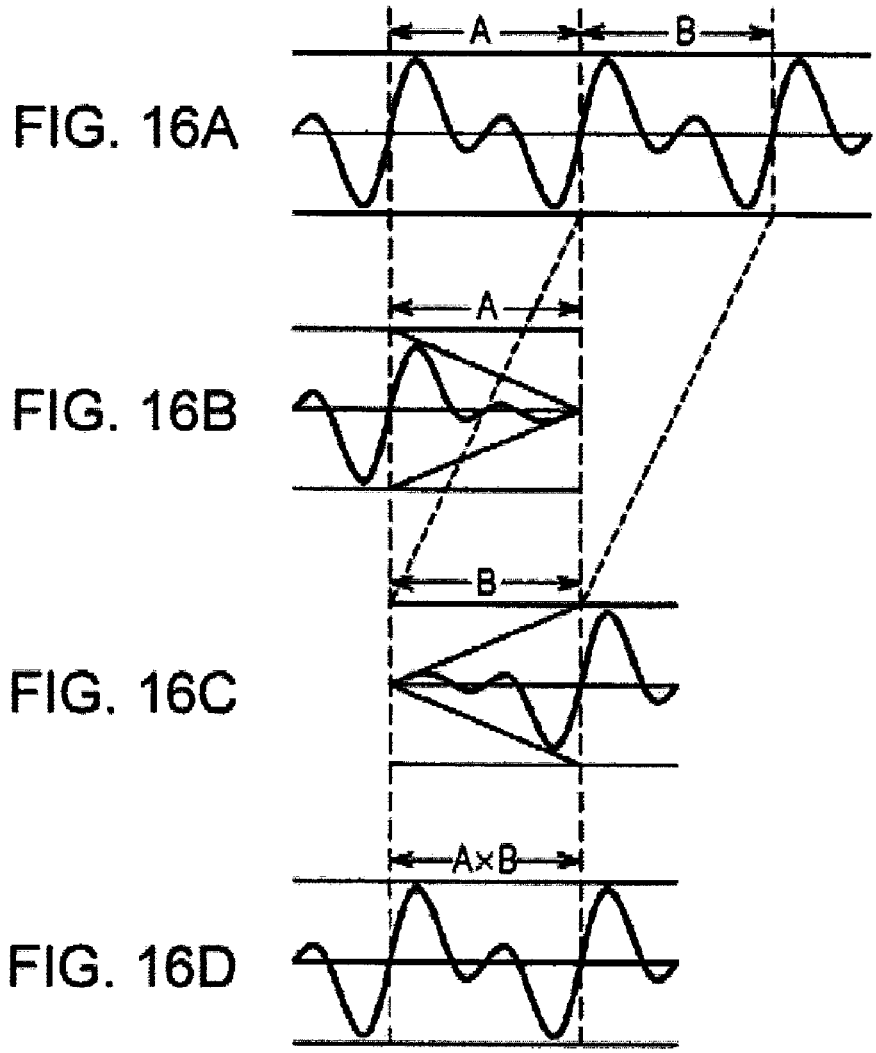

-- PRIOR ART --

-- PRIOR ART --

-- PRIOR ART --

-- PRIOR ART --

-- PRIOR ART --

-- PRIOR ART --

-- PRIOR ART --

-- PRIOR ART --

-- PRIOR ART --

METHOD AND APPARATUS FOR AUDIO SIGNAL EXPANSION AND COMPRESSION

CROSS REFERENCES TO RELATED APPLICATIONS

The present invention contains subject matter related to Japanese Patent Application JP 2006-135545 filed in the Japanese Patent Office on May 15, 2006, the entire contents of which are incorporated herein by reference.

BACKGROUND OF THE INVENTION

1. Field of the Invention

The present invention relates to a method and an apparatus for audio signal expansion and compression for altering the playback speed of music or the like.

2. Description of the Related Art

PICOLA (Pointer Interval Control OverLap and Add) is known as one of the algorithms for expanding and compressing digital audio signals in the time domain. This algorithm advantageously provides good sound quality for voice signals while requiring simple processing and low processing load. PICOLA will be described briefly below with reference to the accompanying drawings. Hereinafter, signals, contained in music or the like, other than voice signals are referred to as acoustic signals, and voice signals and acoustic signals are collectively referred to as audio signals.

FIGS. 13A to 13D show an example of expansion of an original waveform using PICOLA. Firstly, intervals A and B having similar waveforms are found from an original waveform (FIG. 13A). The intervals A and B have an identical number of samples. A fade-out waveform (FIG. 13B) is then generated in the interval B. Similarly, a fade-in waveform (FIG. 13C) is generated from the interval A. An expanded waveform (FIG. 13D) is obtained by adding the waveform shown in FIG. 13B and the waveform shown in FIG. 13C. Adding a fade-out waveform and a fade-in waveform in this way is referred to as cross-fading. Herein, suppose that an interval obtained by cross-fading the intervals A and B is represented as an interval A×B. By performing the above-described operations, the intervals A and B are changed into the interval A, the interval A×B, and the interval B. That is, the intervals A and B are expanded.

FIGS. 14A to 14C are schematic diagrams showing a method for detecting an interval length W of the intervals A and B containing similar waveforms. Firstly, the intervals A and B having j samples are set as shown in FIG. 14A by using a processing start point P0 as an origin. A value of j where the waveforms in the intervals A and B resemble each other the most is determined while gradually increasing j as shown in FIGS. 14A, 14B, and 14C sequentially. For example, the following function D(j) can be used as a scale for measuring the similarity.

$$D(j)=(1/j)\Sigma\{x(i)-y(i)\}^2 \ (i=0 \text{ to } j-1) \quad (1)$$

The value j that gives the minimum value for the function D(j) is determined by calculating the function D(j) in a range of WMIN≦j≦WMAX. The value j determined at this time corresponds to an interval length W of the intervals A and B. Here, x(i) indicates each sampled value in the interval A, whereas y(i) indicates each sampled value in the interval B. In addition, WMAX and WMIN are values of approximately 50 Hz to 250 Hz, for example. If a sampling frequency is set to 8 kHz, WMAX and WMIN are equal to approximately 160 and 32, respectively. In the example shown in FIGS. 14A to 14C, the value j determined in FIG. 14B is selected as the value j that gives the minimum value for the function D(j).

It is important to utilize the foregoing function D(j) to determine the interval length W of similar waveforms. This function is designated to search intervals having waveforms that resemble each other the most and is particularly used in preprocessing for determining the cross-fade interval. In addition, this processing can be applied to waveforms not having pitch, such as a white noise.

FIGS. 15A and 15B are schematic diagrams showing a method for expanding a waveform to a given length. Firstly, as shown in FIGS. 14A to 14C, a processing start point P0 is set as an origin, and a value j that gives the minimum value for the function D(j) is determined. The interval length W is set to equal to j. As shown in FIGS. 15A and 15B, a waveform in an interval 1401 is then copied in an interval 1403, and a cross-fade waveform of waveforms in the intervals 1401 and 1402 is generated in an interval 1404. A waveform in an interval from the point P0 to a point P0' of the original waveform (FIG. 15A) excluding the interval 1401 is copied behind the expanded waveform (FIG. 15B). With the above-described operations, the number of samples in the expanded waveform (FIG. 15B) is increased to W+L samples from L samples in the interval between the point P0 and the point P0' of the original waveform (FIG. 15A). That is, the number of samples is multiplied by "r".

$$r=(W+L)/L \ (1.0<r\leqq 2.0) \quad (2)$$

Equation (3) is obtained by solving Equation (2) with respect to L. It is known that only the point P0' has to be determined as shown in Equation (4) to multiply the number of samples in the original waveform (FIG. 15A) by r.

$$L=W\cdot 1/(r-1) \quad (3)$$

$$P0'=P0+L \quad (4)$$

Furthermore, Equation (6) is obtained by letting 1/r be equal to R as shown in Equation (5).

$$R=1/r \ (0.5\leqq R<1.0) \quad (5)$$

$$L=W\cdot R/(1-R) \quad (6)$$

By using a variable R in this manner, an expression of "playback of the original waveform (FIG. 15A) at R-fold speed" can be used. Hereinafter, this variable R is referred to as a speech speed converting rate. Additionally, in the example shown in FIGS. 15A and 15B, the number of samples L is equivalent to approximately 2.5 W, which corresponds to approximately 0.7-fold slow playback.

After the completion of processing on the interval between the point P0 and the point P0' of the original waveform (FIG. 15A), the point P0' is set as a point P1, i.e., an origin, and similar operations are repeated.

Compression of an original waveform will be described next. FIGS. 16A to 16D show an example of compression of an original waveform using PICOLA. Firstly, intervals A and B having similar waveforms are found from an original waveform (FIG. 16A). The intervals A and B have an identical number of samples. A fade-out waveform (FIG. 16B) is then generated in the interval A. Similarly, a fade-in waveform (FIG. 16C) is generated from the interval B. A compressed waveform (FIG. 16D) is obtained by adding the waveform shown in FIG. 16B and the waveform shown in FIG. 16C. By performing the above-described operations, the intervals A and B are changed into an interval A×B.

FIGS. 17A and 17B show a method for compressing a waveform to a given length. Firstly, as shown in FIGS. 14A to 14C, a processing start point P0 is set as an origin, and a value j that gives the minimum value for the function D(j) is determined. The interval length W is set to j. As shown in FIGS. 17A and 17B, a cross-fade waveform of waveforms in the intervals 1601 and 1602 is generated in an interval 1603. A waveform in an interval from the point P0 to a point P0' of the original waveform (FIG. 17A) excluding the intervals 1601 and 1602 is copied behind the compressed waveform (FIG. 17B). With the above-described operations, the number of samples in the compressed waveform (FIG. 17B) is decreased to L samples from W+L samples in the interval from the point P0 to the point P0' of the original waveform (FIG. 17A). That is, the number of samples is multiplied by "r".

$$r=L/(W+L)\ (0.5\leqq r<1.0) \tag{7}$$

Equation (8) is obtained by solving Equation (7) with respect to L. It is known that only the point P0' has to be determined as shown in Equation (9) to multiply the number of samples in the original waveform (FIG. 17A) by r.

$$L=W\cdot r/(1-r) \tag{8}$$

$$P0'=P0+(W+L) \tag{9}$$

Furthermore, Equation (11) is obtained by letting 1/r be equal to R as shown in Equation (10).

$$R=1/r\ (1.0<R\leqq 2.0) \tag{10}$$

$$L=W\cdot 1/(R-1) \tag{11}$$

By using a variable R in this manner, an expression of "playback of the original waveform (FIG. 17A) at R-fold speed" can be used. After the completion of processing on the interval between the point P0 and the point P0' of the original waveform (FIG. 17A), the point P0' is set as a point P1, i.e., an origin, similar operations are repeated.

In the example shown in FIGS. 17A and 17B, the number of samples L is equivalent to approximately 1.5 W, which corresponds to approximately 1.7-fold fast playback.

FIG. 18 is a flowchart showing a process flow of waveform expansion in PICOLA. At STEP S1001, whether an audio signal to be processed exists in an input buffer or not is determined. If the audio signal does not exist in the input buffer, the process is terminated. If the audio signal to be processed exists, the process proceeds to STEP S1002. A processing start point P is set as an origin, and a value j that gives a minimum value for a function D(j) is determined. An interval length W is set equal to the value j. At STEP S1003, a value L is determined from a speech speed converting rate R specified by a user. At STEP S1004, data corresponding to an interval A for W samples from the processing start point P is output to an output buffer. At STEP S1005, a cross-fade waveform of waveforms in the interval A containing W samples from the processing start point P and the interval B containing the next W samples is determined and set as an interval C. At STEP S1006, the data in the interval C is output to the output buffer. At STEP S1007, data for L-W samples is output (copied) to the output buffer from a point P+W in the input buffer. At STEP S1008, the processing start point P is moved to the point P+L. The process then returns to STEP S1001, and the above-described steps are repeated.

FIG. 19 is a flowchart showing a process flow of waveform compression in PICOLA. At STEP S1101, whether an audio signal to be processed exists in an input buffer or not is determined. If the audio signal does not exist, the process is terminated. If the audio signal to be processed exists, the process proceeds to STEP S1102. A processing start point P is set as an origin, and a value j that gives a minimum value for a function D(j) is determined. An interval length W is set equal to the value j. At STEP S1103, a value L is determined from a speech speed converting rate R specified by a user. At STEP S1104, a cross-fade waveform of waveforms in the interval A containing W samples from the processing start point P and the interval B containing the next W samples is determined and set as an interval C. At STEP S1105, the data in the interval C is output to an output buffer. At STEP S1106, data for L-W samples is output (copied) to the output buffer from a point P+2 W in the input buffer. At STEP S1107, the processing start point P is moved to the point P+(W+L). The process then returns to STEP S1101, and the above-described steps are repeated.

FIG. 20 shows an example of a configuration of a speech speed converting apparatus 100 using PICOLA. An input buffer 101 buffers an audio signal to be processed. A similar waveform length extracting unit 102 determines a value j that gives a minimum value for a function D(j) using the audio signal contained in the input buffer 101, and sets an interval length W equal to j. The input buffer 101 is supplied with the information about the interval length W determined by the similar waveform length extracting unit 102. The input buffer 101 utilizes the interval length W for buffer operations. The similar waveform length extracting unit 102 supplies the audio signals for 2 W samples to a connected waveform generating unit 103. The connected waveform generating unit 103 cross-fades the received audio signals for 2 W samples to generate a cross-fade waveform for W samples. Audio signals are sent to an output buffer 104 from the input buffer 101 and the connected waveform generating unit 103 in accordance with the speech speed converting rate R. An audio signal generated in the output buffer 104 is output from the speech speed converting apparatus as an output audio signal.

Now, a similar waveform length extracting process using a speech speed converting algorithm PICOLA will be described with reference to flowcharts shown in FIGS. 21 and 22. At STEP S1201, an index j is set to an initial value WMIN. At STEP S1202, a subroutine is executed. The subroutine calculates the function D(j) represented by Equation (12) as a scale for measuring the similarity.

$$D(j)=(1/j)\Sigma\{f(i)-f(j+i)\}\hat{}2\ (i=0\text{ to }j-1) \tag{12}$$

Here, f(j) indicates an input audio signal. For example, in an example shown in FIGS. 14A to 14C, f(j) indicates samples from the point P0. Additionally, Equations (1) and (12) represent the same content. Equation (12) is used hereinafter.

At STEP S1203, the value of the function D(j) determined by the subroutine is substituted for a variable min, and the index j is substituted for the interval length W. At STEP S1204, the index j is incremented by 1. At STEP S1205, whether the index j is greater than WMAX or not is determined. If the index j is not greater than WMAX, the process proceeds to STEP S1206. On the other hand, if the index j is greater than WMAX, the process is terminated.

The value of the variable W at the time of termination of the process corresponds to the index j that minimizes the function D(j), i.e., the length of a similar waveform. The value of the variable min at that time indicates the minimum value of the function D(j).

At STEP S1206, a subroutine determines the value of the function D(j) for the new index j. At STEP S1207, whether the value of the function D(j) determined at STEP S1206 is greater than the variable min or not is determined. If the value of the function D(j) is not greater than min, the process proceeds to STEP S1208. If the value of the function D(j) is greater than min, the process returns to STEP S1204. At STEP S1208, the value of the function D(j) is substituted for the variable min, and the value of the index j is substituted for the interval length W.

FIG. 22 shows a process flow of the subroutine. At STEP S1209, an index i and a variable s are reset to 0. At STEP S1210, whether the index i is smaller than the index j or not is determined. If the index i is smaller than the index j, the process proceeds to STEP S1211. If the index i is not smaller than the index j, the process proceeds to STEP S1213. At STEP S1211, a square of a difference between the input audio signals is determined, and is added to the variable s.

$$s=s+\{f(i)-f(j+i)\}^2 \quad (13)$$

At STEP S1212, the index i is incremented by 1, and the process returns to STEP S1210. At STEP S1213, a value of the function D(j) is set to a value obtained by dividing the variable s by the index j, and the subroutine is terminated.

$$D(j)=s/i \quad (14)$$

FIG. 23 is a diagram for illustrating a similar waveform length extracting process described in FIGS. 21 and 22. In this example, WMIN and WMAX are set to 3 and 10, respectively. A value of function D(j) is determined while sequentially increasing the index j by 1 from 3 to 10. The value of the function D(j) becomes smaller when waveforms are more similar. Accordingly, the value of the function D(j) becomes minimum when j=8, and the interval length W is equal to 8.

As described above, a speech speed converting algorithm PICOLA can expand and compress audio signals at a given speech speed converting rate R (where, $0.5 \leqq R < 1.0$, $1.0 < R \leqq 2.0$) by extracting the length of similar waveforms.

PICOLA is described in, for example, an article by Morita and Itakura entitled "Time-Scale Modification Algorithm for Speech By Use of Pointer Interval Control Overlap and Add (PICOLA) and its Evaluation", Proceeding of National Meeting of the Acoustic Society of Japan, October, 1986, pp. 149-150.

SUMMARY OF THE INVENTION

Although existing PICOLA can provide a good sound quality regarding voice signals, it may be difficult to provide a good sound quality regarding acoustic signals such as music. This results from that waveforms of various frequencies are overlapped in acoustic signals since music generally contains sounds of various musical instruments.

FIG. 24 shows an example of a waveform of an acoustic signal, which is sampled at a sampling frequency of 44.1 kHz and the duration of which is 848 milliseconds. FIG. 25 shows a result of extracting similar intervals from the example waveform shown in FIG. 24 using the above-mentioned function D(j) represented by Equation (12). Firstly, a starting point 2401 of the waveform is set as an origin. An index j that gives the minimum value for the function D(j) is determined, and an interval length W is set to the value of the index j. A point 2402 indicates a point of the Wth sample from the point 2401. Then, similarly, the point 2402 is set as an origin. The value of j that gives the minimum value for the function D(j) is determined, and the interval length W is set to the value of j. A point 2403 indicates a point of the Wth sample from the point 2402. A point 2404 is determined similarly. Thereafter, similar operations are performed for the end of the waveform.

FIG. 25 shows defects regarding the value of the function D(j). A beginning part of an interval 1 has narrow gaps, and the other part has broader and substantially uniform gaps. Regarding an interval 2, a beginning part has narrow gaps as in the case of the interval 1, and the other part substantially has broader gaps but the gaps are not uniform. In this case, it is noticeable that the gaps in the part other than the beginning part are substantially uniform in the interval 1, whereas the gaps in the part other than the beginning part are not uniform in the interval 2. In PICOLA, expansion and compression of waveforms are performed on the basis of this gap W. If the gap W (i.e., a similar waveform length) varies as shown in the interval 2, noises may be caused in the expanded or compressed waveform. A problem here is that the detection results for a waveform that should have substantially uniform gaps W are not uniform.

It is considered that the main reason that the value of a similar waveform length W varies is that the number of samples used for calculation of the function D(j) differs depending on the value j. The example shown in FIG. 23 is considered here. If the index j=3, the function D(j) is calculated for the sum of 6 samples, i.e., 3 samples+3 samples. On the other hand, if the index j=10, the function D(j) is calculated for the sum of 20 samples, i.e., 10 samples+10 samples. Accordingly, in the case where the number of used samples differs, accurate detection can be performed for a large number of samples, like j=10. However, the value of the function D(j) may accidentally becomes small for a small number of samples, like j=3.

As represented by Equation (12), the definitional equation of the function D(j) determines an arithmetic mean of squares of differences. Suppose that n random variables X1, X2, . . . , Xn follow probability distribution, an expectation is set to μ, and a variance is set to $\sigma^2$. In such a case, an expectation E(X') and a variance V(X') of the arithmetic mean X' are generally represented by the following equations.

$$X'=(X1+X2+\ldots+Xn)/n \quad (15)$$

$$E(X')=\mu \quad (16)$$

$$V(X')=(\sigma^2)/n \quad (17)$$

These equations indicate that the variance decreases in reverse proportion to an increase in n. For example, in the case of n=160 (=WMAX), the variance becomes ⅕ of that obtained in the case of n=32 (=WMIN). That is, when n is equal to 32, the variance is five-times larger than that obtained when n is equal to 160, which indicates that effects of noises or the like can be applied more easily. Thus, in the known method, the degree of being affected by noises or the like significantly differs depending on the value n.

Additionally, a small value j often gives a small value for the function D(j) accidentally since audio signals generally have complicated waveforms. If the value of the function D(j) accidentally becomes small at the small value j, listeners may hear noises. This is because waveforms of voice signals change significantly, whereas waveforms of acoustic signals are often steady to some extent.

Embodiments of the present invention are made in view of these disadvantages, and provide a method and an apparatus for expanding and compressing audio signals that provides a good sound quality.

According to an embodiment of the present invention, an audio signal expansion and compression method for expanding and compressing an audio signal in a time domain, includes the steps of setting an initial value of a signal comparison length of a first comparison interval and a second comparison interval, used for detection of two similar waveforms in the audio signal, equal to or larger than a minimum waveform detection length, determining an interval length of the two similar waveforms while changing a shift amount of the first comparison interval and the second comparison interval so that the shift amount does not exceed the signal comparison length, and expanding or compressing the audio signal in the time domain on the basis of the interval length of the two similar waveforms.

Additionally, according to another embodiment of the invention, an audio signal expansion and compression apparatus for expanding and compressing an audio signal in the time domain, includes a unit for setting an initial value of a signal comparison length of a first comparison interval and a second comparison interval, used for detection of two similar waveforms in the audio signal, equal to or larger than a minimum waveform detection length, a unit for determining an interval length of the two similar waveforms while changing a shift amount of the first comparison interval and the second comparison interval so that the shift amount does not exceed the signal comparison length, and a unit for expanding or compressing the audio signal in the time domain on the basis of the interval length of the two similar waveforms.

According to the embodiments of the present invention, the initial value of the signal comparison length of the first comparison interval and the second comparison interval, used for the detection of two similar waveforms in the audio signal, is set equal to or larger than the minimum waveform detection length. The interval length of the similar waveforms is determined by changing the shift amount of the first comparison interval and the second comparison interval so that the shift amount does not exceed the signal comparison length. In such a way, good sound quality can be obtained.

BRIEF DESCRIPTION OF THE DRAWINGS

FIGS. 13A to 13D are schematic diagrams showing an example of expansion of an original waveform using PICOLA;

FIGS. 16A to 16D are schematic diagrams showing an example of compression of an original waveform using PICOLA;

DESCRIPTION OF THE PREFERRED EMBODIMENTS

Embodiments of the present invention will be described below with reference to the drawings. An audio signal expansion and compression method described as specific embodiments is to improve circumstances that a value of a function D(j), used as a scale for measuring a similarity to detect two similar waveforms in an audio signal, accidentally becomes small in a small interval j.

Figure 1:
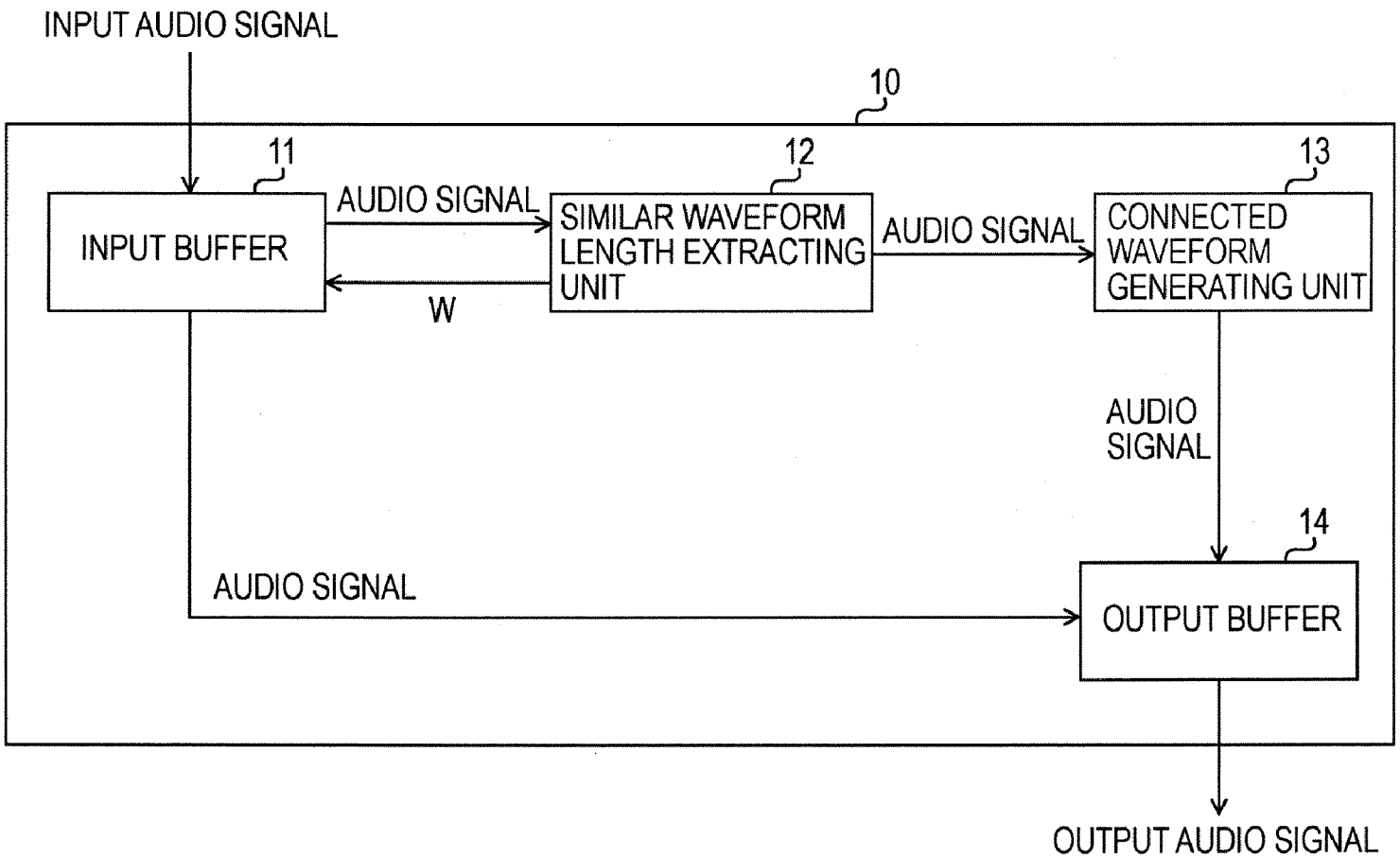
FIG. 1 is a block diagram showing a configuration of an audio signal expansion and compression apparatus according to a first embodiment of the present invention.

FIG. 1 is a block diagram showing an example of a configuration of an audio signal expansion and compression apparatus according to a first embodiment of the present invention. An audio signal expansion and compression apparatus 10 has an input buffer 11, a similar waveform length extracting unit 12, a connected waveform generating unit 13, and an output buffer 14. The input buffer 11 buffers input audio signals. The similar waveform length extracting unit 12 extracts a length of similar waveforms (for 2 W samples) from the audio signal buffered in the input buffer 11. The connected waveform generating unit 13 cross-fades the audio signals for 2 W samples to generate a connected waveform for W samples. The output buffer 14 outputs an output audio signal, containing the input audio signal and a signal of the connected waveform, supplied thereto in accordance with a speech speed converting rate R.

The input buffer 11 buffers the input audio signal to be processed. As described later, the similar waveform length extracting unit 12 extracts an interval length W of two similar waveforms from the audio signal buffered in the input buffer 11. The interval length W of the similar waveforms extracted by the similar waveform length extracting unit 12 is supplied to the input buffer 11 and is utilized for buffer operations. The similar waveform length extracting unit 12 outputs the audio signals for 2 W samples to the connected waveform generating unit 13. The connected waveform generating unit 13 cross-fades the received audio signals for 2 W samples to generate the connected waveform for W samples. The input buffer 11 and the connected waveform generating unit 13 output the audio signals to the output buffer 14 in accordance with the speech speed converting rate R. The audio signals buffered in the output buffer 14 are output from the audio signal expansion and compression apparatus 10 as an output audio signal.

Figure 2:
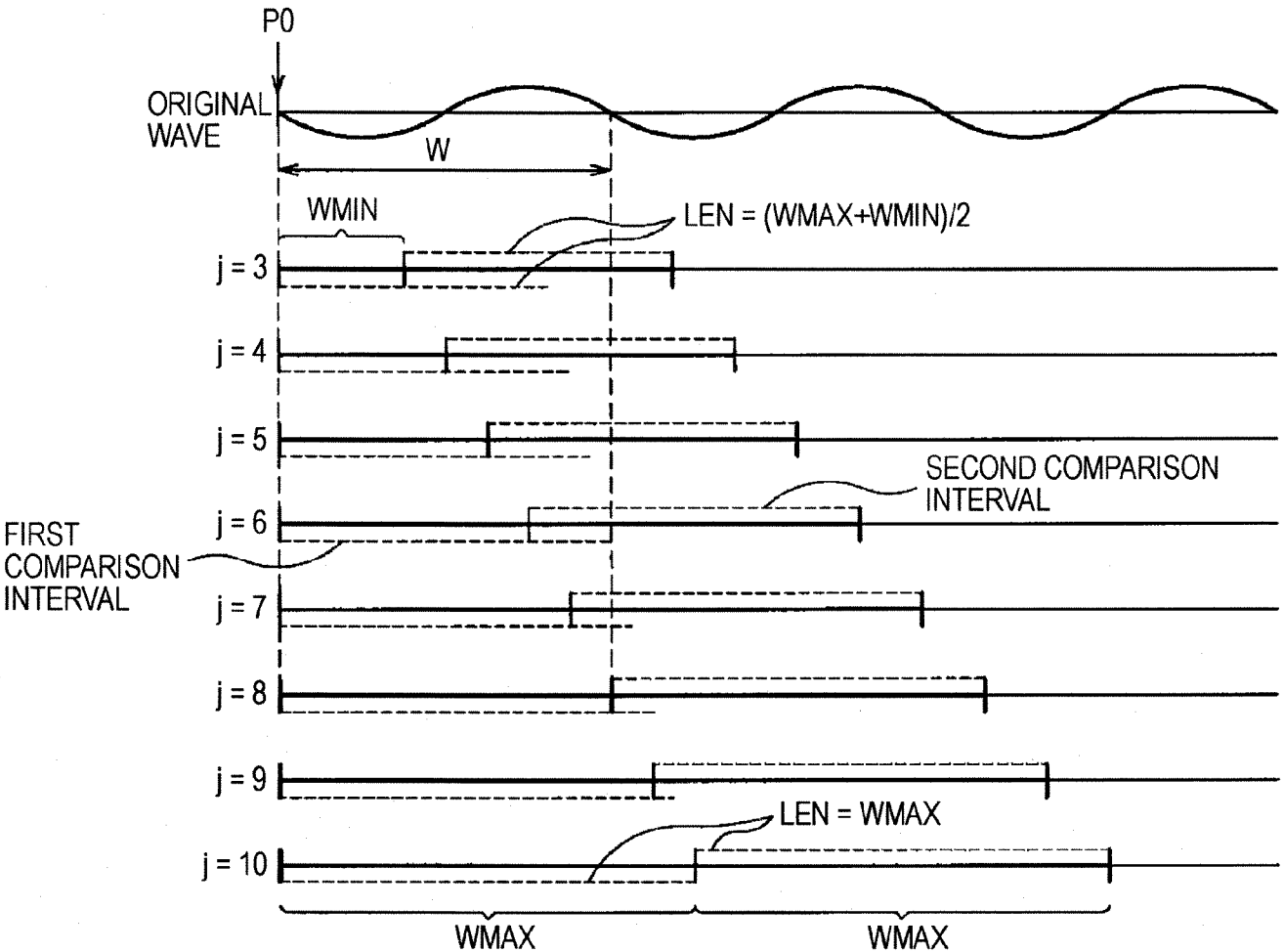
FIG. 2 is a schematic diagram for illustrating a similar waveform length extracting process according to a first embodiment of the present invention.

Now, a waveform length extracting process performed by the similar waveform length extracting unit 12 will be described. As shown in FIG. 2, the similar waveform length extracting unit 12 sets a first comparison interval and a second comparison interval to overlap each other in the audio signal buffered in the input buffer 11 using a processing start point P0 as an origin. The similar waveform length extracting unit 12 also sets a signal comparison length LEN of the first and second comparison intervals.

$$LEN=(j+WMAX)/2 \tag{18}$$

The similar waveform length extracting unit 12 determines an index j, i.e., a shift amount, where waveforms in the first and second comparison intervals resemble each other the most while gradually shifting the first and second comparison intervals as shown in FIG. 2. For example, the following function D(j) can be used as a scale for measuring the similarity.

$$D(j)=(1/j)\Sigma\{f(i)-f(j+i)\}^2 \ (i=0 \text{ to } LEN-1) \tag{19}$$

The similar waveform length extracting unit 12 calculates the function D(j) in a range of WMIN≦j≦WMAX, and determines the index j that gives the minimum value for the functions D(j). The index j determined at this time corresponds to the interval length W of the similar waveforms detected in the comparison intervals. Here, f(i) indicates each sampled value in the first comparison interval, whereas f(j+i) indicates each sampled value in the second comparison interval. Additionally, WMAX and WMIN are values of approximately 50 Hz to 250 Hz, for example. If a sampling frequency is set to 8 kHz, WMAX and WMIN are equal to 160 and 32, respectively.

In an example shown in FIG. 2, WMIN and WMAX are set equal to 3 and 10, respectively. The similar waveform length extracting unit 12 determines the value of the function D(j) while incrementing the index j by 1 from 3 to 10. Since the value of the function D(j) become smaller when the waveforms are more similar, the value of the function D(j) becomes minimum when j=8. Thus, the interval length W is set equal to 8.

A flow of a process performed by a processing unit, an example of which is similar waveform length extracting unit 12, will be described next using a flowchart shown in FIG. 3. At STEP S101, the similar waveform length extracting unit 12 sets the index j equal to an initial value WMIN. At STEP S102, the similar waveform length extracting unit 12 executes a subroutine, which is described later. The subroutine calculates the function D(j) as a scale of measuring the similarity.

At STEP S103, the similar waveform length extracting unit 12 substitutes the value of the function D(j) determined by the subroutine for a variable min, and substitutes the index j for the interval length W. At STEP S104, the similar waveform length extracting unit 12 increments the index j by 1. At STEP S105, the similar waveform length extracting unit 12 determines whether or not the index j is greater than WMAX. If the index j is not greater than WMAX, the process proceeds to STEP S106, whereas, if the index j is greater than WMAX, the process is terminated.

The value of the variable W at the time of termination of the process corresponds to the index j that minimizes the function D(j), namely, a similar waveform length. The value of variable min at that time corresponds to the minimum value of the function D(j).

At STEP S106, a subroutine determines a value of function D(j) for new index value j. At STEP S107, the similar waveform length extracting unit 12 determines whether or not the value of the function D(j) determined at STEP S106 is greater than the variable min. If the value of the function D(j) is not greater than the variable min, the process proceeds to STEP S108, whereas, if the value of the function D(j) is greater than the variable min, the process returns to STEP S104. At STEP S108, the similar waveform length extracting unit 12 substitutes the value of the function D(j) for the variable min, and substitutes the index j for the interval length W.

Figure 4:
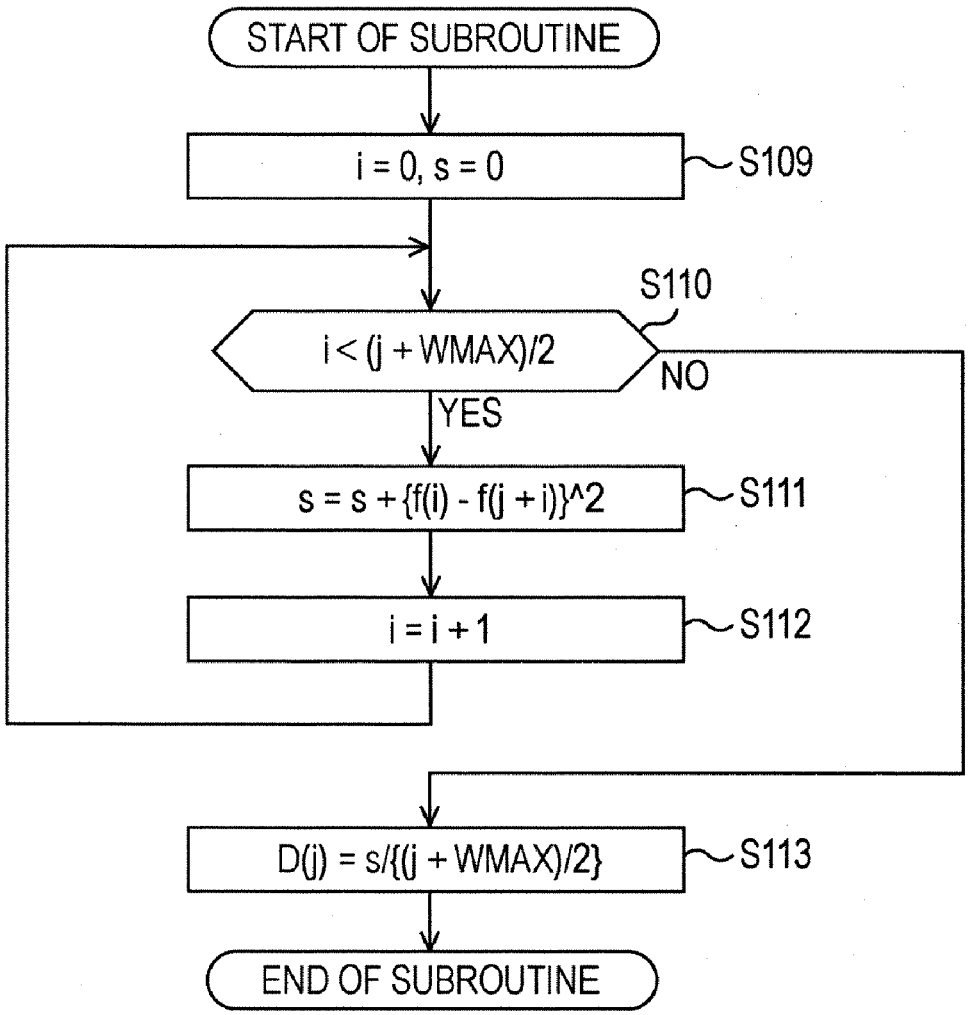
FIG. 4 is a flowchart showing a process of a subroutine of a similar waveform length extracting process according to a first embodiment of the present invention.

In addition, a flow of the process of the subroutine is as illustrated in a flowchart shown in FIG. 4. At STEP S109, an index i and a variable s are reset to 0. At STEP S110, whether or not the index i is smaller than a value (j+WMAX)/2 is determined. If the index i is smaller than the value (j+WMAX)/2, the process proceeds to STEP S111. If the index i is not smaller than the value (j+WMAX)/2, the process proceeds to STEP S113. At STEP S111, a square of a difference between the input audio signals is determined, and is added to the variable s. At STEP S112, the index i is incremented by 1, and the process returns to STEP S110. At STEP S113, a value obtained by dividing the variable s by the value (j+WMAX)/2 is set to the function D(j), and the subroutine is terminated.

Figure 23:
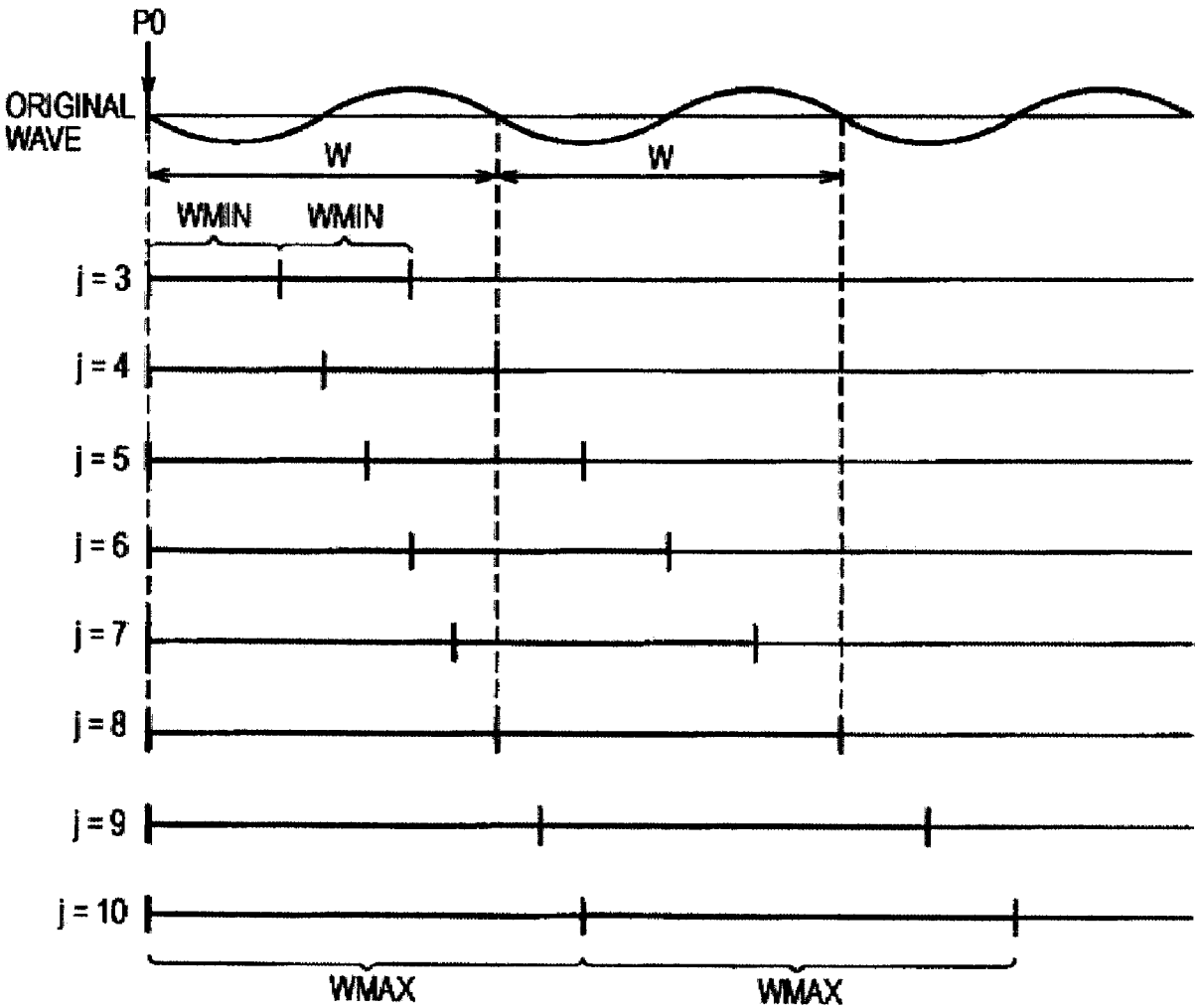
FIG. 23 is a schematic diagram for illustrating a known similar waveform length extracting process.

As described above, a problem that the value of the function D(j) accidentally becomes small at the small index value j can be prevented by increasing the number of samples in comparison intervals, for which the similarity has been calculated using a small number of samples. For example, comparison of a case of detecting similar waveforms shown in FIG. 2 with a case of detecting similar waveforms in a known manner shown in FIG. 23 reveals that the function D(j) is calculated using longer intervals in a case employing the embodiment of the present invention when the index j is small. In the example shown in FIG. 2, the lengths of the intervals differ the most when index j=3. When index j=10, the lengths do not differ.

Figure 5:
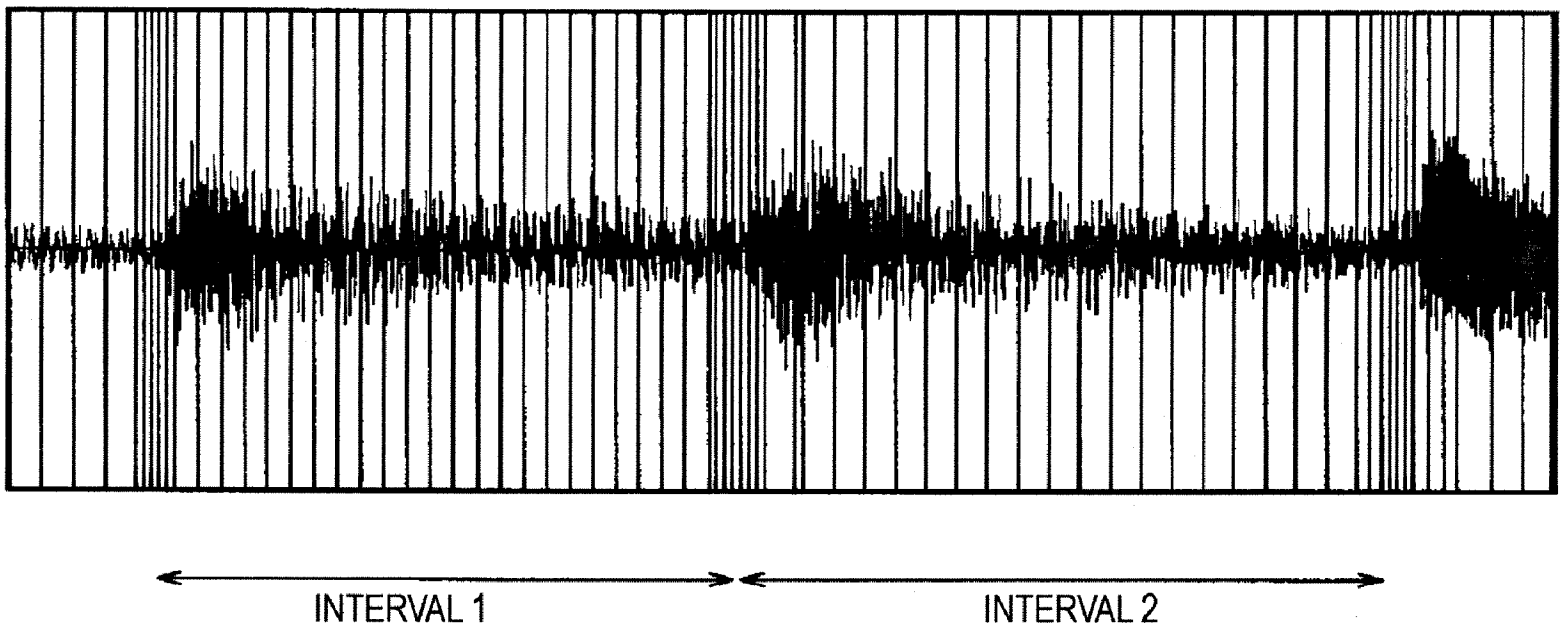
FIG. 5 is a diagram showing a result of extraction of similar intervals from an example waveform by means of a similar waveform length extracting process according to a first embodiment of the present invention.
Figure 24:
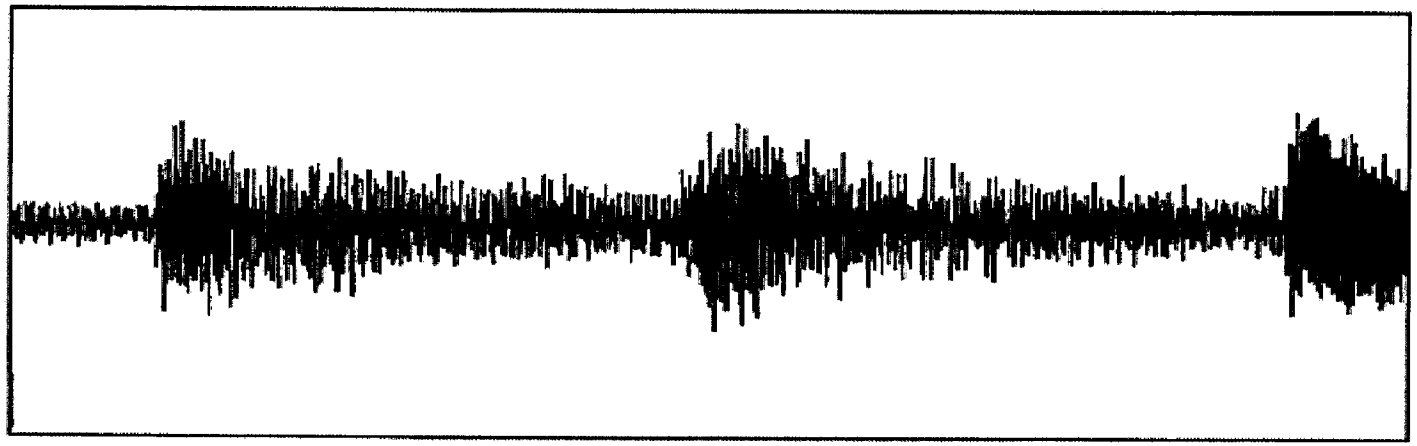
FIG. 24 is a schematic diagram showing an example waveform of an acoustic signal.
Figure 25:
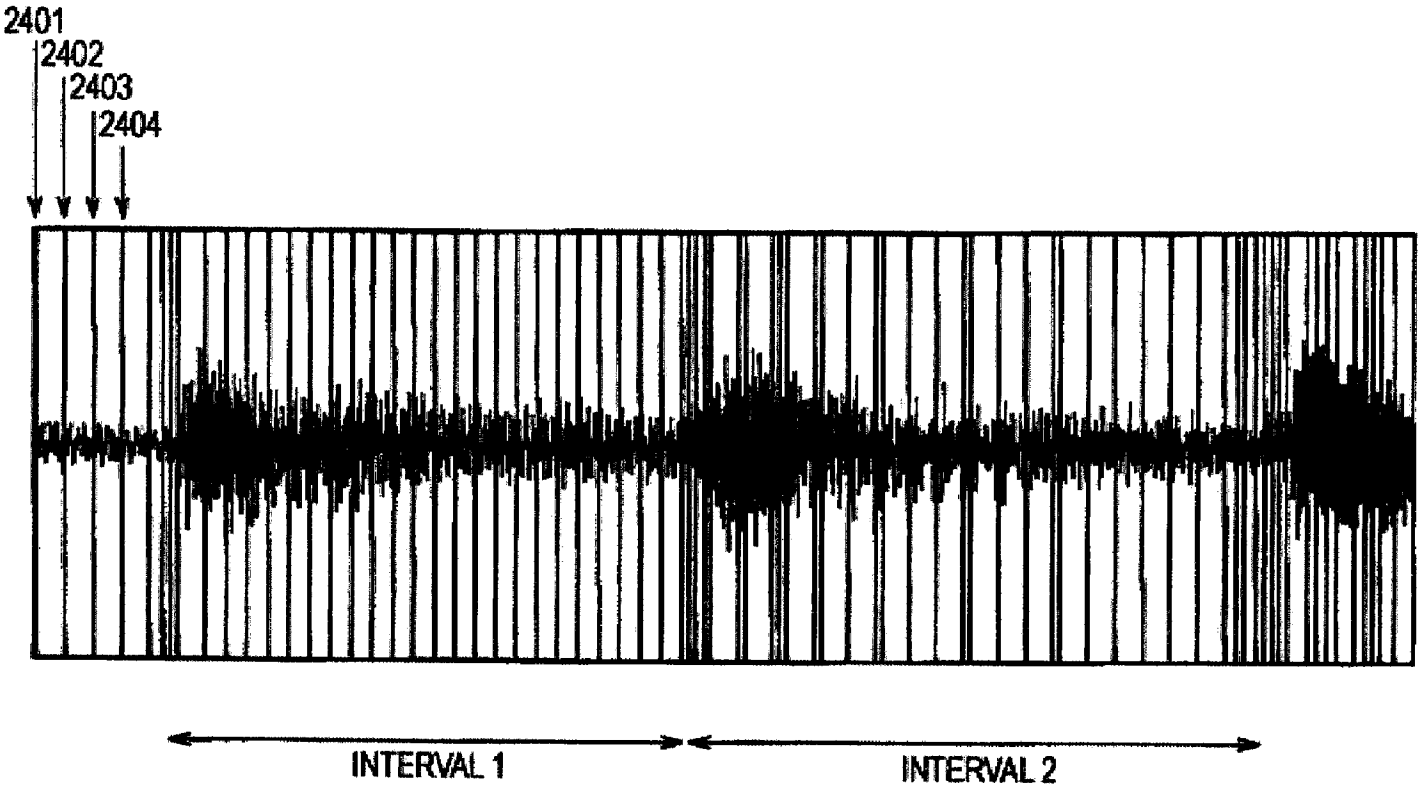
FIG. 25 is a diagram showing a result of extraction of similar intervals from an example waveform by means of a known similar waveform length extracting process.

FIG. 5 is a diagram showing a result obtained by performing a process shown in FIG. 2 on a waveform shown in FIG. 24. When compared with the result, shown in FIG. 25, obtained by performing a known process, significant reduction of variations in gaps in a part other than beginning of an interval 2 is easily recognizable. When this waveform is played back, suppression of noises can be confirmed aurally.

A similar waveform length extracting process according to a second embodiment of the present invention will be described next. The similar configurations as those of the audio signal expansion and compression apparatus according to the first embodiment are denoted by like reference numerals, and the description thereof is omitted here.

According to the second embodiment, a signal comparison length LEN is set to a larger value as shown in the following equation.

$$LEN=WMAX \tag{20}$$

Figure 6:
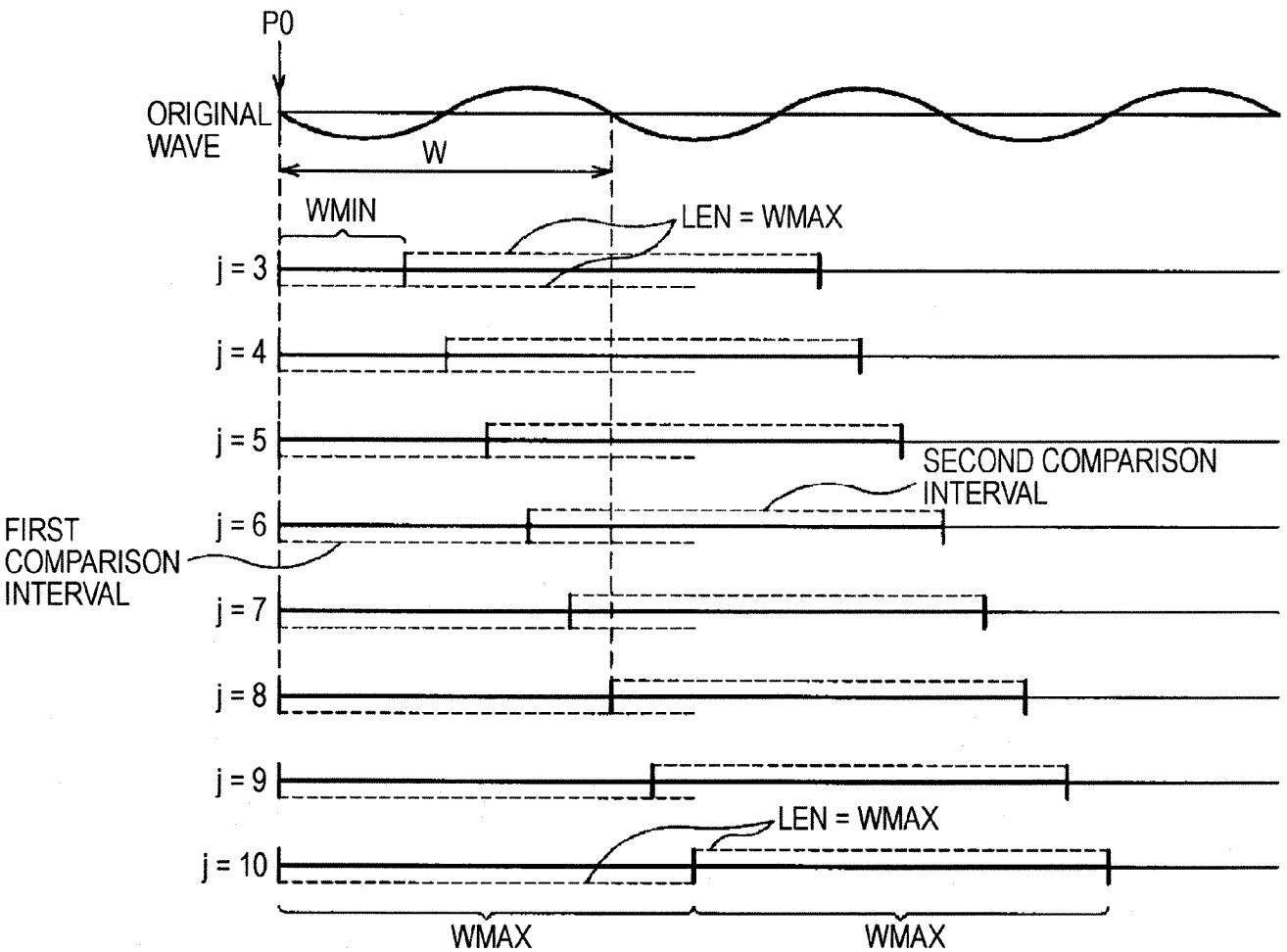
FIG. 6 is a schematic diagram for illustrating a similar waveform length extracting process according to a second embodiment of the present invention.

FIG. 6 is a schematic diagram for illustrating a similar waveform length extracting process according to the second embodiment of the present invention. In this example, WMIN and WMAX are set equal to 3 and 10, respectively. A similar waveform length extracting unit 12 determines a value of a function D(j) while incrementing an index j by 1 from 3 to 10. Since the value of the function D(j) becomes small when the waveforms are more similar, the value of the function D(j) becomes minimum when j=8. Thus, an interval length W is set equal to 8.

Figure 3:
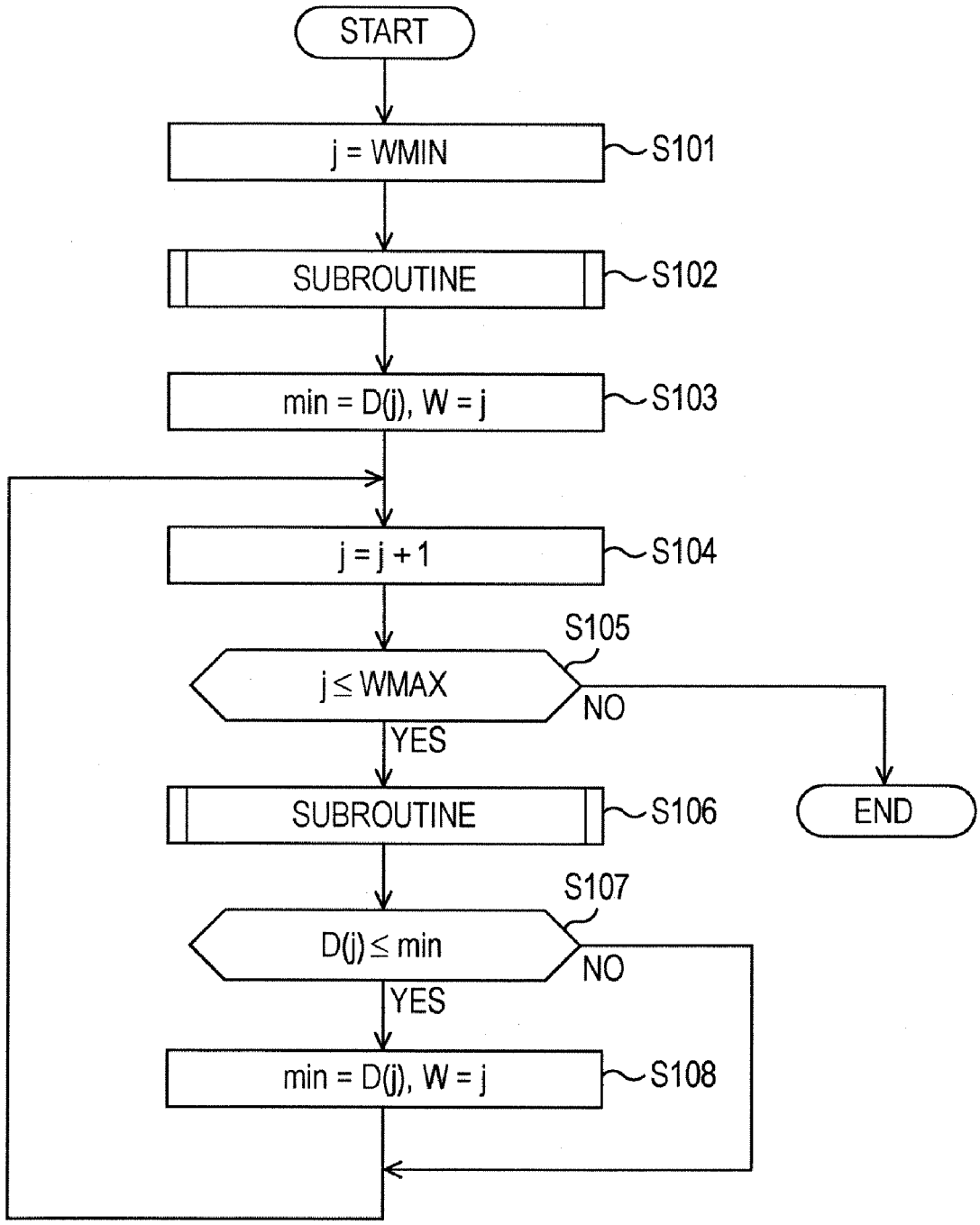
FIG. 3 is a flowchart showing a flow of a process performed by a similar waveform length extracting unit according to a first embodiment of the present invention.

A flowchart of the similar waveform length extracting process according to the second embodiment is the same as that of the similar waveform length extracting process according to the first embodiment shown in FIG. 3. A process of a subroutine that calculates the value of the function D(j) differs.

The function D(j) represented by Equation (21) can be used as in the case of Equation (19).

$$D(j)=(1/j)\Sigma\{f(i)-f(j+i)\}^2 \ (i=0 \text{ to } LEN-1) \quad (21)$$

The similar waveform length extracting unit 12 calculates the function D(j) in a range of WMIN≦j≦WMAX, and determines the index j that gives the minimum value for the function D(j) using a subroutine described next.

Figure 7:
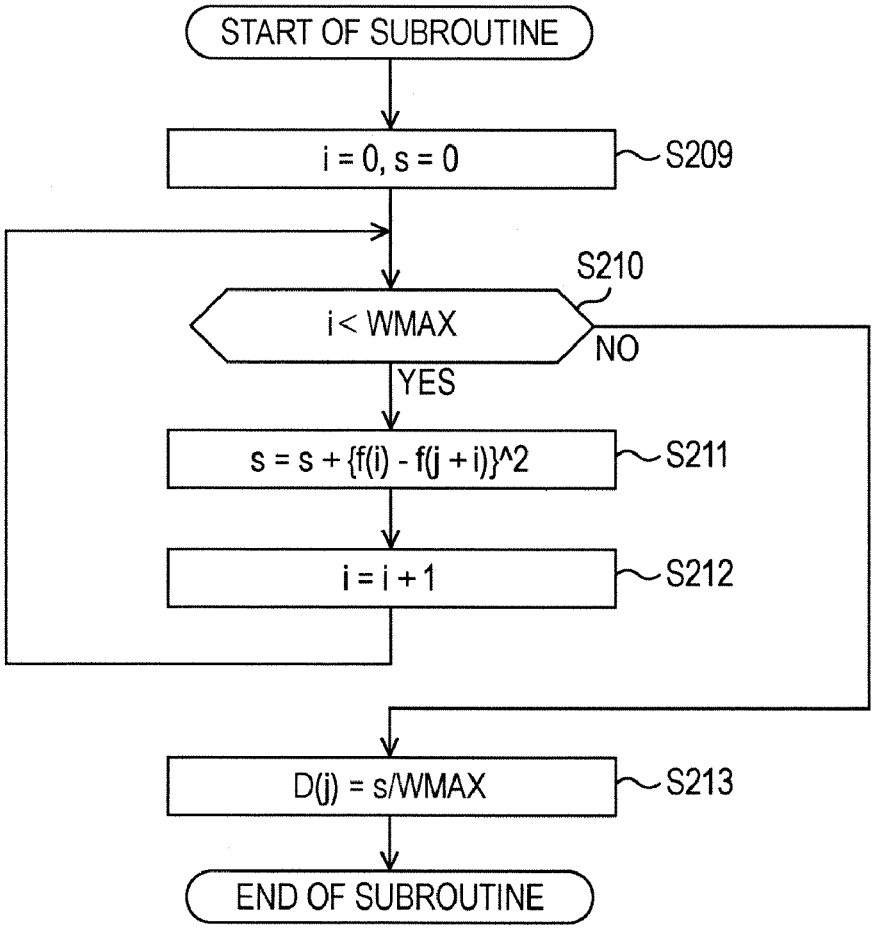
FIG. 7 is a flowchart showing a process of a subroutine of a similar waveform length extracting process according to a second embodiment of the present invention.

FIG. 7 is a flowchart of a subroutine of the similar waveform length extracting process according to the second embodiment. At STEP S209, an index i and a variable s are reset to 0. At STEP S210, whether or not the index i is smaller than the value WMAX is determined. If the index i is smaller than the value WMAX, the process proceeds to STEP S211. If the index i is not smaller than the value WMAX, the process proceeds to STEP S213. At STEP S211, a square of a difference between the input audio signals is determined, and is added to the variable s. At STEP S212, the index i is incremented by 1, and the process returns to STEP S210. At STEP S213, the value of the function D(j) is set to a value obtained by dividing the variable s by the value WMAX, and the subroutine is terminated.

As described above, a problem that the value of the function D(j) accidentally becomes small at the small index value j can be prevented by increasing the number of samples in the comparison intervals, for which the similarity has been calculated using a small number of samples. For example, comparison of a case of detecting similar waveforms shown in FIG. 6 with a case of detecting similar waveforms in a known manner shown in FIG. 23 reveals that the function D(j) is calculated using longer intervals in a case where the embodiment of the present invention is applied when the index j is small. In the example shown in FIG. 6, the lengths of the intervals differ the most when index j=3. When index j=10, the lengths do not differ.

A similar waveform length extracting process according to a third embodiment of the present invention will be described next. The similar configurations as those of the audio signal expansion and compression apparatus according to the first embodiment are denoted by like reference numerals, and the description thereof is omitted here.

According to the third embodiment, a signal comparison length LEN is set to a larger value as represented by the following equation.

$$LEN=2W\text{MAX}-j \quad (22)$$

Figure 8:
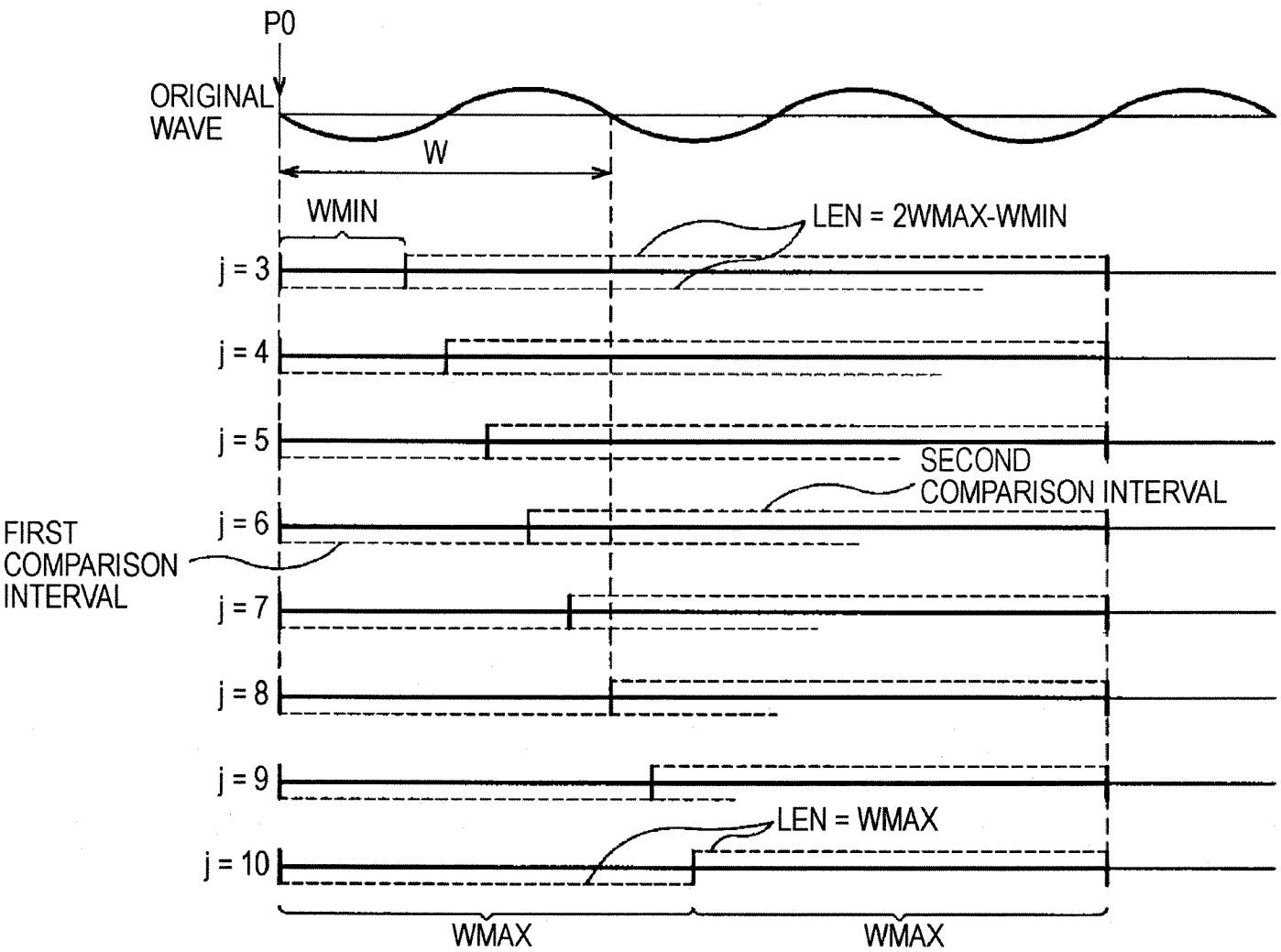
FIG. 8 is a schematic diagram illustrating a similar waveform length extracting process according to a third embodiment of the present invention.

FIG. 8 is a schematic diagram for illustrating a similar waveform length extracting process according to the third embodiment of the present invention. In this example, WMIN and WMAX are set equal to 3 and 10, respectively. A similar waveform length extracting unit 12 determines a value of the function D(j) while incrementing an index j by 1 from 3 to 10. Since the value of the function D(j) becomes smaller when the waveforms are more similar, the value of the function D(j) becomes minimum when j=8. Thus, an interval length W is set equal to 8.

A flowchart of the similar waveform length extracting process according to the third embodiment is the same as that of the similar waveform length extracting process according to the first embodiment shown in FIG. 3. A process of a subroutine that calculates the function D(j) differs.

The function D(j) represented by Equation (23) can be used as in the case of Equation (19).

$$D(j)=(1/j)\Sigma\{f(i)-f(j+i)\}^2 \ (i=0 \text{ to } LEN-1) \quad (23)$$

The similar waveform length extracting unit 12 calculates the function D(j) in a range of WMIN≦j≦WMAX, and determines the index j that gives the minimum value for the functions D(j) using a subroutine described next.

Figure 9:
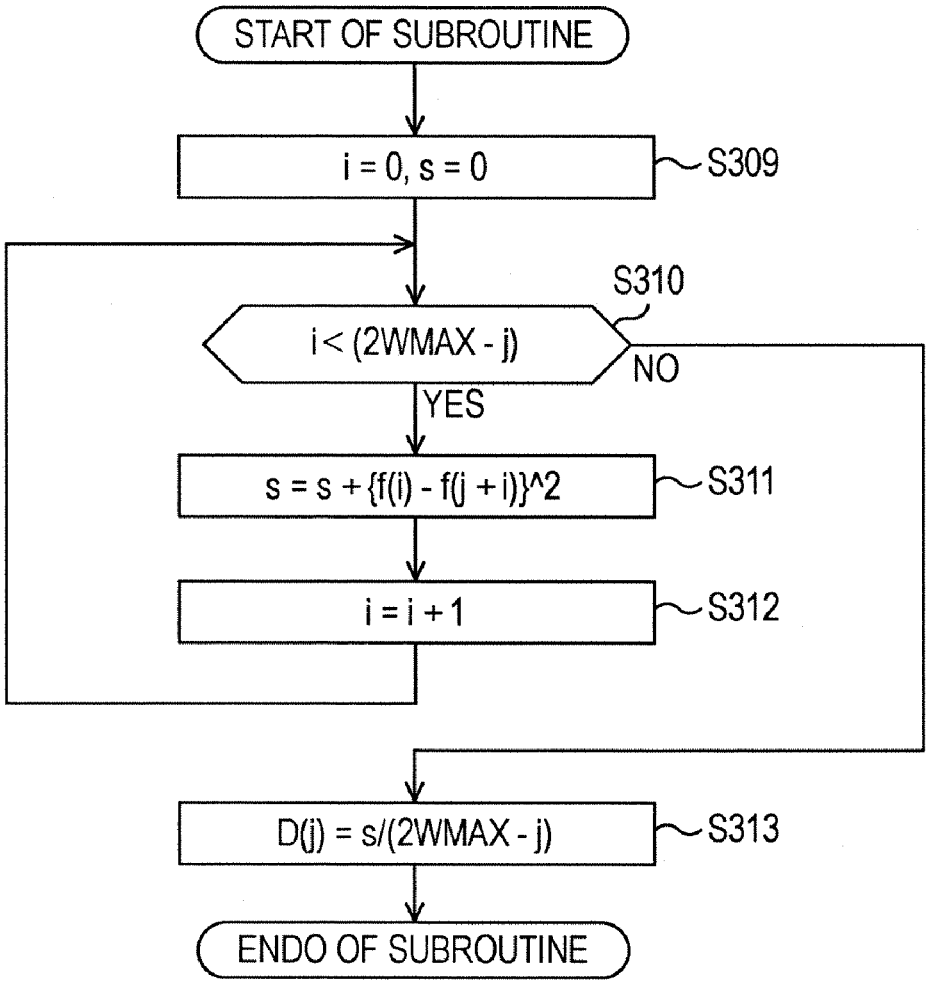
FIG. 9 is a flowchart showing a process of a subroutine of a similar waveform length extracting process according to a third embodiment of the present invention.

FIG. 9 is a flowchart of a subroutine of the similar waveform length extracting process according to the third embodiment. At STEP S309, an index i and a variable s are reset to 0. At STEP S310, whether or not the index i is smaller than a value 2WMAX-j is determined. If the index i is smaller than the value 2WMAX-j, the process proceeds to STEP S311. If the index i is not smaller than the value 2WMAX-j, the process proceeds to STEP S313. At STEP S311, a square of a difference between the input audio signals is determined, and is added to the variable s. At STEP S312, the index i is incremented by 1, and the process returns to STEP S310. At STEP S313, the value of the function D(j) is set to a value obtained by dividing the variable s by the value 2WMAX-j, and the subroutine is terminated.

As described above, a problem that the value of the function D(j) accidentally becomes small at the small index value j can be prevented by increasing the number of samples in the comparison intervals, for which the similarity has been calculated using a small number of samples. For example, comparison of a case of detecting similar waveforms shown in FIG. 8 with a case of detecting similar waveforms in a known manner shown in FIG. 23 reveals that the function D(j) is calculated using longer intervals in a case where the embodiment of the present invention is applied when the index j is small. In the example shown in FIG. 8, the lengths of the intervals differ the most when index j=3. When index j=10, the lengths do not differ.

Meanwhile, a longer interval length used in calculation of the function D(j) does not necessarily result in a better result, and the length has to be set suitably. If an input signal is expected to include many voice signals, the initial value LENMIN of the signal comparison length LEN is set relatively short. More specifically, the initial value LENMIN is set to a value that is between WMIN and (WMIN+WMAX)/2 and is near the WMIN. If an input signal is expected to include many acoustic signals, the initial length LENMIN is set relatively long. More specifically, the length LENMIN is set to a value that is between WMAX and (WMIN+WMAX)/2 and is near WMAX. With the above configuration, good sound quality can be obtained. In particular, an input signal is expected to include voice signals and acoustic signals, the length LENMIN is set to a value near (WMIN+WMAX)/2, thereby providing good sound quality. In summary, the signal comparison length LEN and the initial value LENMIN of the signal comparison length may be in a range shown below.

$$\text{LENMIN} \leqq \text{LEN} \leqq \text{WMAX} \quad (24)$$

$$\text{WMIN} < \text{LENMIN} < \text{WMAX} \quad (25)$$

Here, the initial value of the signal comparison length LEN is in a range between WMIN+1 and WMAX−1. The signal comparison length LEN increases to WMAX.

Whether the input signal from a sound source is an acoustic signal or a voice signal can be determined depending on whether the sound source is a recorder, such as an IC (integrated circuit) recorder, or an audio apparatus. For example, when an audio signal expansion and compression apparatus is connected to these apparatuses via an IEEE (Institute of Electrical and Electronics Engineers) 1394 cable, identification information may be read out from the apparatuses and the initial value LENMIN may be set in accordance with the identification information. Additionally, the initial value LENMIN may be set by users.

In addition, Equation (26) can be used in a similar waveform length extracting process as the function D(j) as in the case of Equation (19). A flowchart of the similar waveform length extracting process is the same as that shown in FIG. 3.

$$D(j)=(1/j)\Sigma\{f(i)-f(j+i)\}^2 \ (i=0 \text{ to } LEN-1) \tag{26}$$

The similar waveform length extracting unit 12 calculates the function D(j) in a range of WMIN≦j≦WMAX, and determines the index j that gives the minimum value for the functions D(j) using a subroutine described next.

Figure 10:
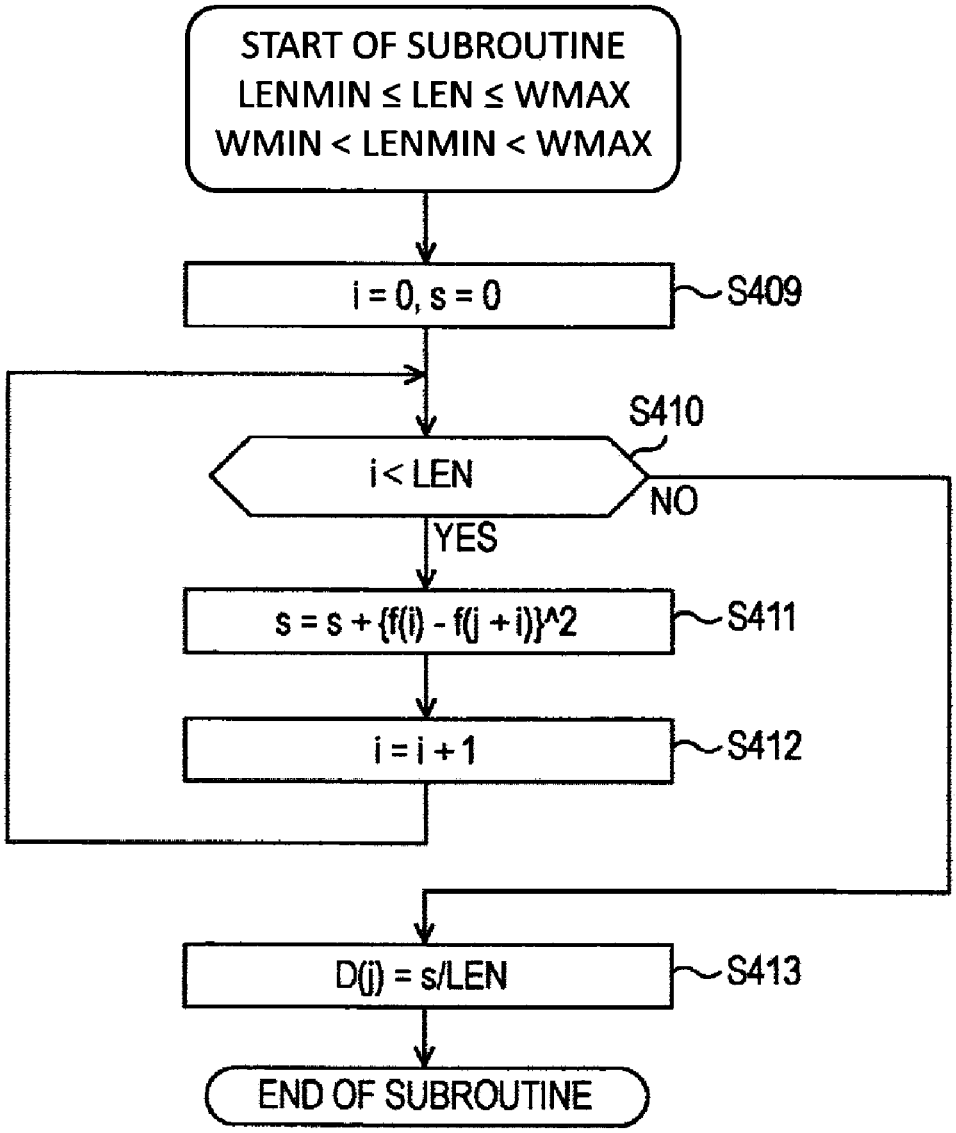
FIG. 10 is a flowchart showing a process of a subroutine of a similar waveform length extracting process in a case where a signal comparison length is determined by Equations (24) and (25)

FIG. 10 is a flowchart of a subroutine of the similar waveform length extracting process corresponding to the signal comparison length LEN represented by Equations (24) and (25). At STEP S409, an index i and a variable s are reset to 0. At STEP S410, whether or not the index i is smaller than a value LEN is determined. If the index i is smaller than the value LEN, the process proceeds to STEP S411. If the index i is not smaller than the value LEN, the process proceeds to STEP S413. At STEP S411, a square of a difference between the input audio signals is determined, and is added to the variable s. At STEP S412, the index i is incremented by 1, and the process returns to STEP S410. At STEP S413, the value of the function D(j) is set to a value obtained by dividing the variable s by the value LEN, and the subroutine is terminated.

With such a configuration, a problem that a large interval length W is mistakenly detected in an interval, for which a small interval length W should be detected, and that noises are caused as a result can be prevented regarding signals, such as voice signals, that changes significantly. In addition, regarding not only voice signals but also acoustic signals having significant changes, a problem that a large interval length W is mistakenly detected in an interval, for which a small interval length W should be detected, and that noises are caused as a result can be prevented.

Furthermore, an acoustic likelihood M of the input audio signal can be used as an example of a method for adaptively setting LEN. Here, the acoustic likelihood M is a numeric indicator indicating a likelihood of the input signal being an acoustic signal. For example, if the input signal is obviously a voice signal, the acoustic likelihood M is equal to 0, whereas, if the input signal is obviously an acoustic signal, the acoustic likelihood M is equal to 1. In neither case, the acoustic likelihood M is set equal to 0.5. For example, a variance of the number of zero crossing or a spectrum variation can be used as a method for determining whether the input signal is the voice signal or the acoustic signal. The number of zero crossing indicates the number of times that a waveform crosses zero in a frame. If the variance of the number of zero crossing is small, the input signal tends to be an acoustic signal, whereas, if the variance is large, the input signal tends to be a voice signal. Additionally, the spectrum variation indicates variations of spectrum between neighboring frames. The input signal tends to be an acoustic signal if the spectrum variation is small, whereas the input signal tends to be a voice signal if the spectrum variation is large. Such a tendency is caused because acoustic signals have more steady signals, while voice signals have repetitions of voiced sounds and unvoiced sounds.

Figure 11:
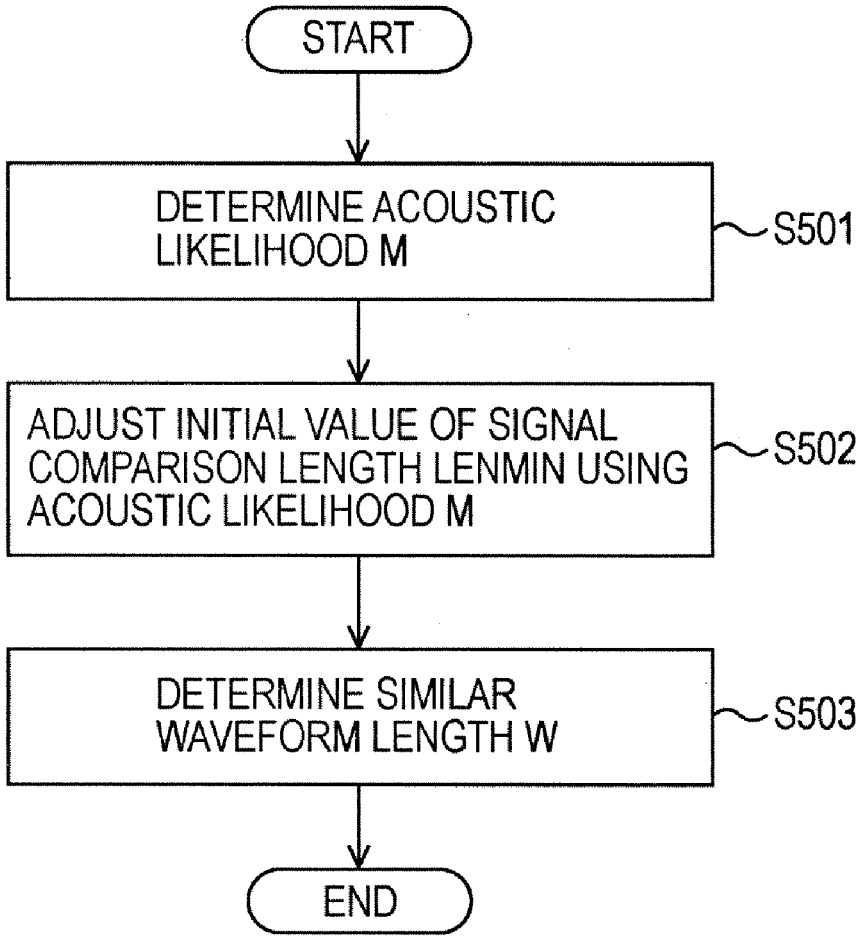
FIG. 11 is a flowchart showing a similar waveform length extracting process employing an acoustic likelihood M.

FIG. 11 is a flowchart showing a similar waveform length extracting process using the acoustic likelihood M. As described above, at STEP S501, the acoustic likelihood M is determined using, for example, the variance of the number of zero crossing or the spectrum variation. At STEP S502, the initial value LENMIN of the signal comparison length is adjusted using the acoustic likelihood M. For example, if the acoustic likelihood M is equal to 0, the initial value LENMIN of the signal comparison length may be set equal to WMIN, whereas the initial value LENMIN of the signal comparison length may be set equal to WMAX if the acoustic likelihood M is equal to 1. Additionally, if the acoustic likelihood M is equal to 0.5, the initial value LENMIN of the signal comparison length may be set to (WMIN+WMAX)/2. The signal comparison length LEN and the initial value LENMIN of the signal comparison length may be in a range shown below.

$$\text{LENMIN} \leqq \text{LEN} \leqq \text{WMAX} \tag{27}$$

$$\text{WMIN} \leqq \text{LENMIN} \leqq \text{WMAX} \tag{28}$$

Here, the initial value of the signal comparison length LEN is in a range between WMIN and WMAX. The signal comparison length LEN increases to WMAX.

At STEP S503, the minimum value of the function D(j) is determined while adjusting the length LEN appropriately. Equation (29) can be used as the function D(j) as in the case of Equation (19). A flowchart for the similar waveform length extracting process is the same as that shown in FIG. 3.

$$D(j)=(1/j)\Sigma\{f(i)-f(j+i)\}^2 \ (i=0 \text{ to } LEN-1) \tag{29}$$

The similar waveform length extracting unit 12 calculates the function D(j) in a range of WMIN≦j≦WMAX, and determines the index j that gives the minimum value for the functions D(j) using a subroutine described next.

Figure 12:
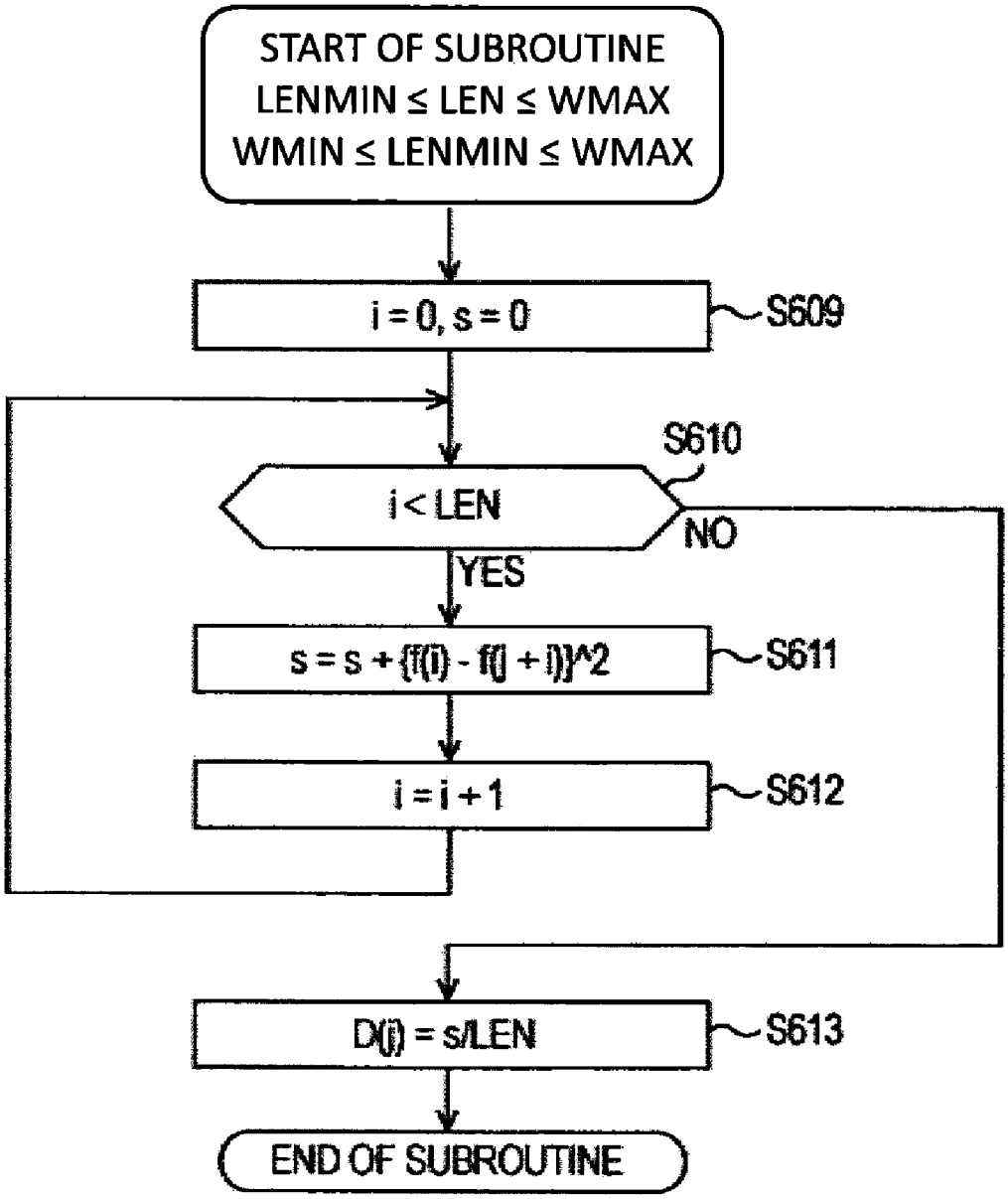
FIG. 12 is a flowchart showing a process of a subroutine of a similar waveform length extracting process in a case where a signal comparison length is determined by Equations (27) and (28)
Figure 14A:
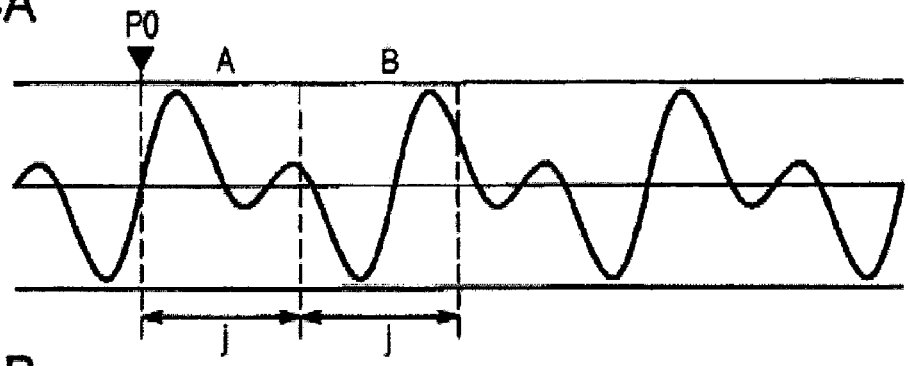
FIGS. 14A to 14C are schematic diagrams showing a method for detecting a interval length W of intervals A and B containing similar waveforms.
Figure 14B:
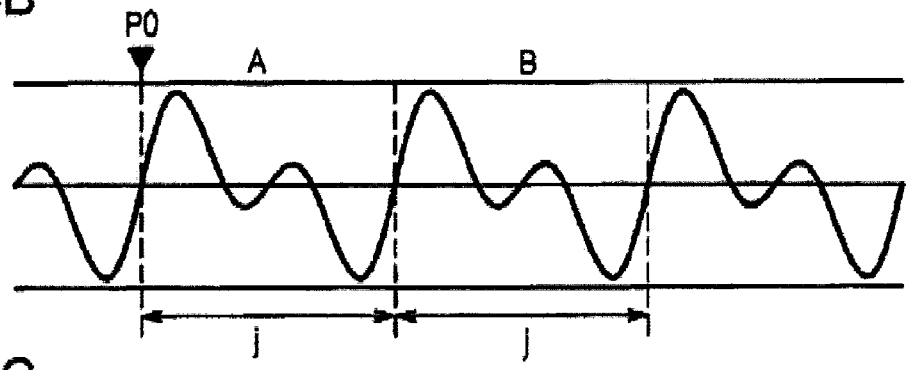
Figure 14C:
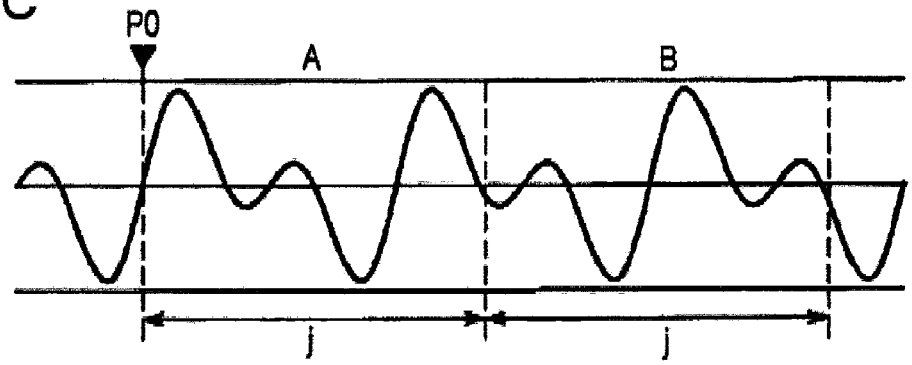
Figures 15A, 15B:
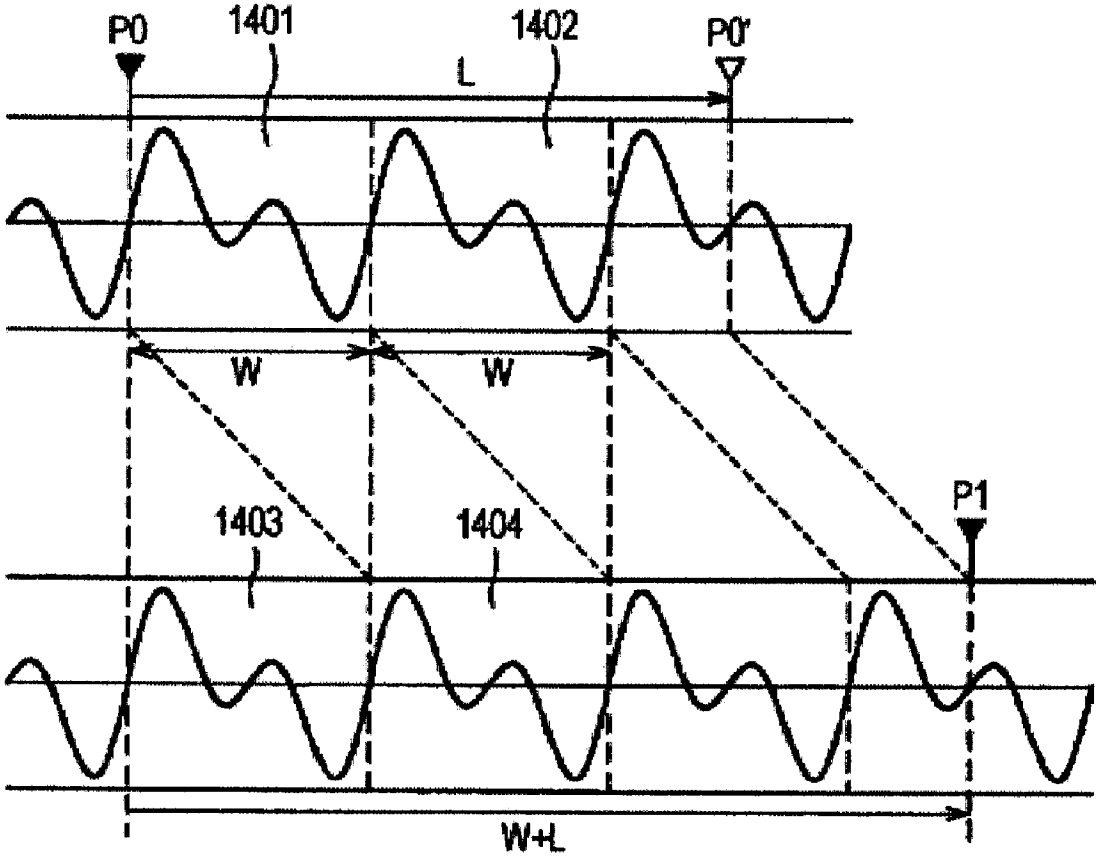
FIGS. 15A and 15B are schematic diagrams showing a method for expanding a waveform to a given length.
Figures 17A, 17B:
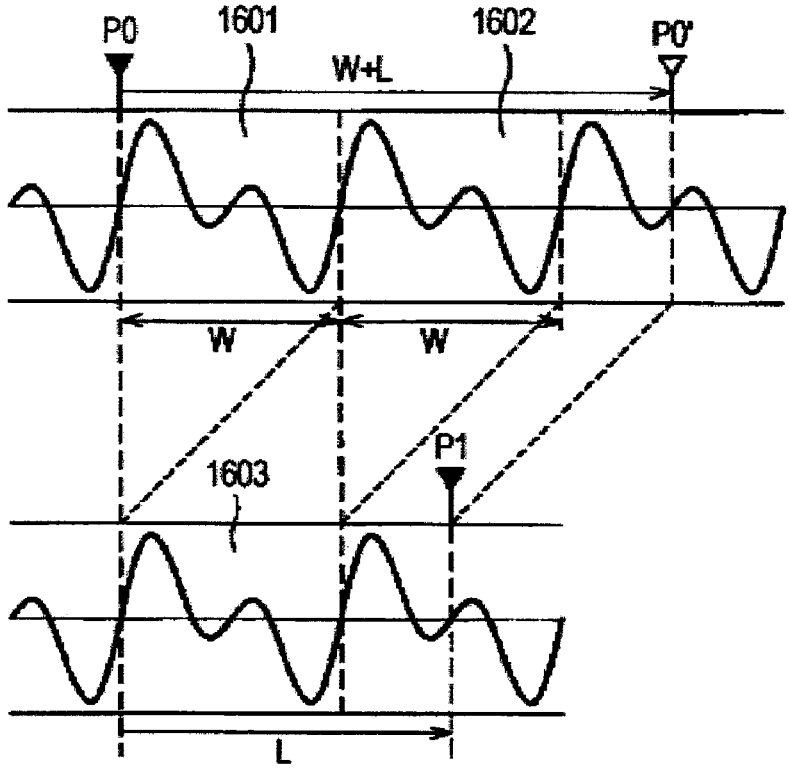
FIGS. 17A and 17B are schematic diagrams showing a method for compressing a waveform to a given length.
Figure 18:
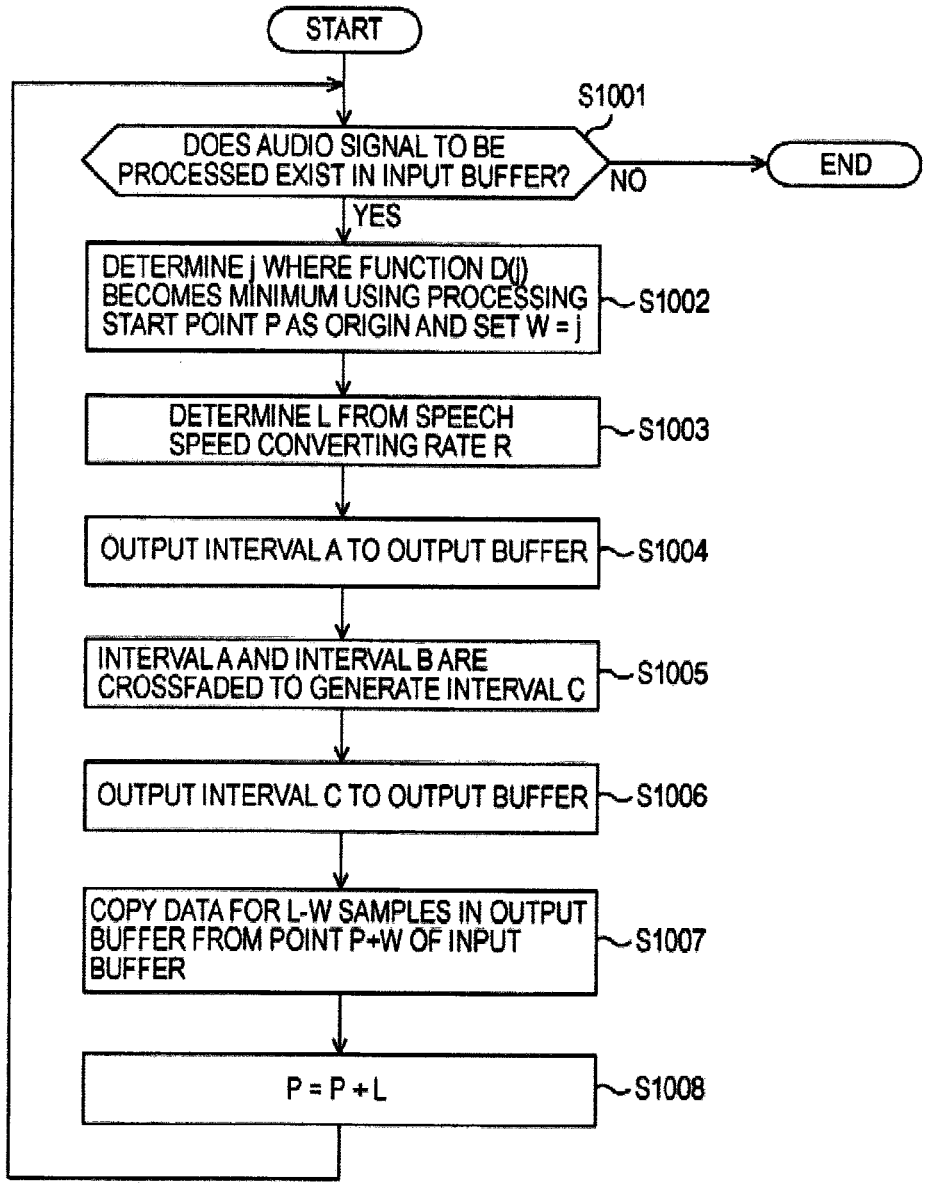
FIG. 18 is a flowchart showing a process flow of waveform expansion in PICOLA.
Figure 19:
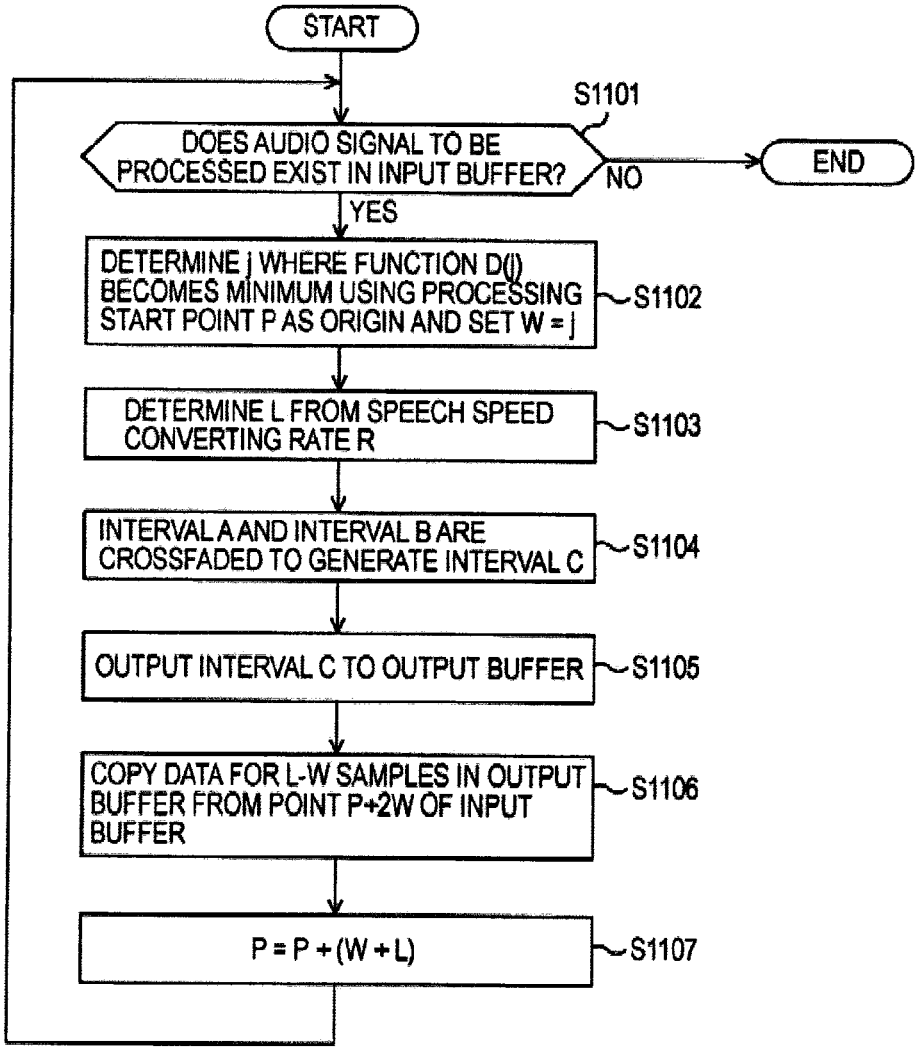
FIG. 19 is a flowchart showing a process flow of waveform compression in PICOLA.
Figure 20:
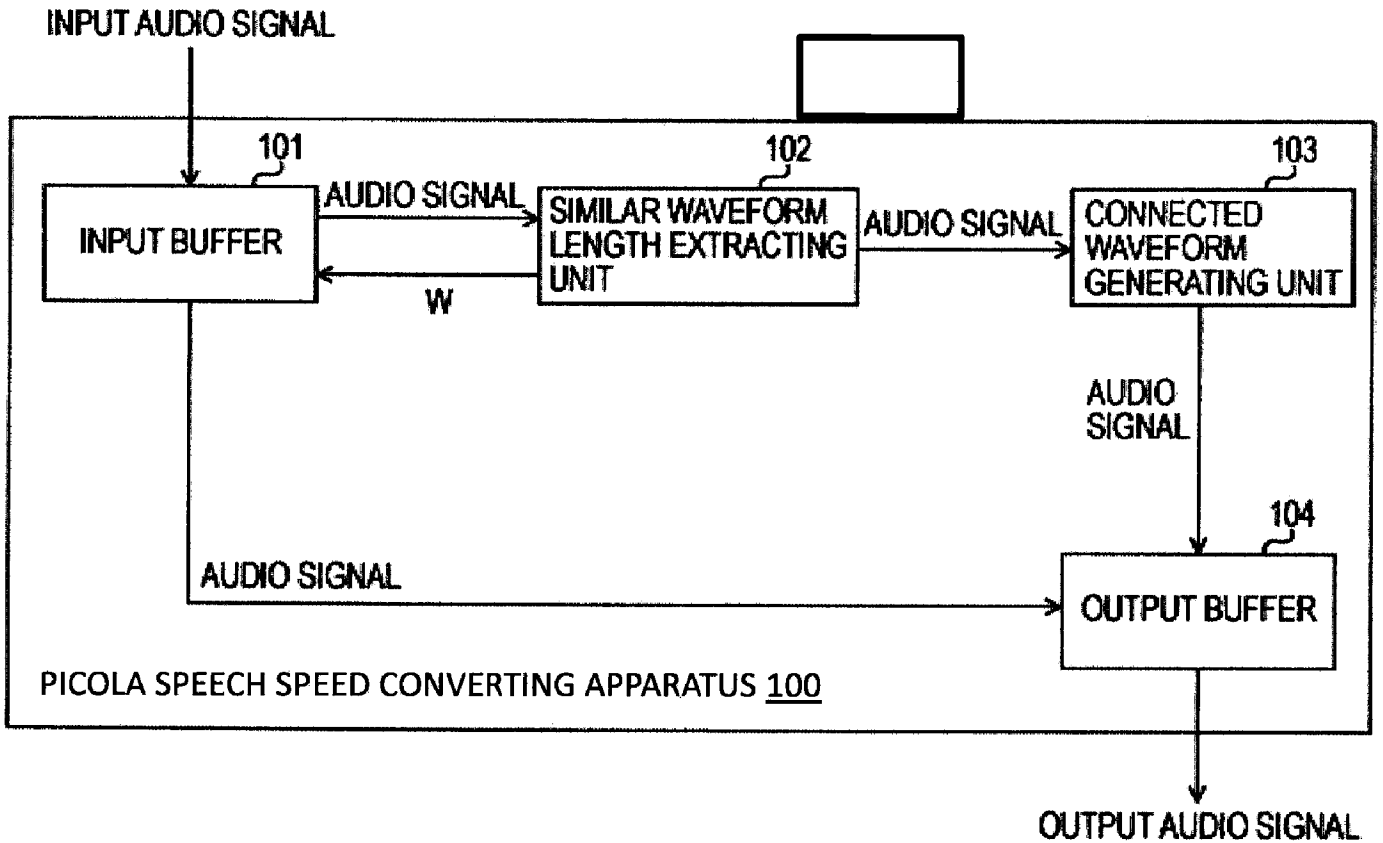
FIG. 20 is a block diagram showing an example of a configuration of a speech speed converting apparatus that employs PICOLA.
Figure 21:
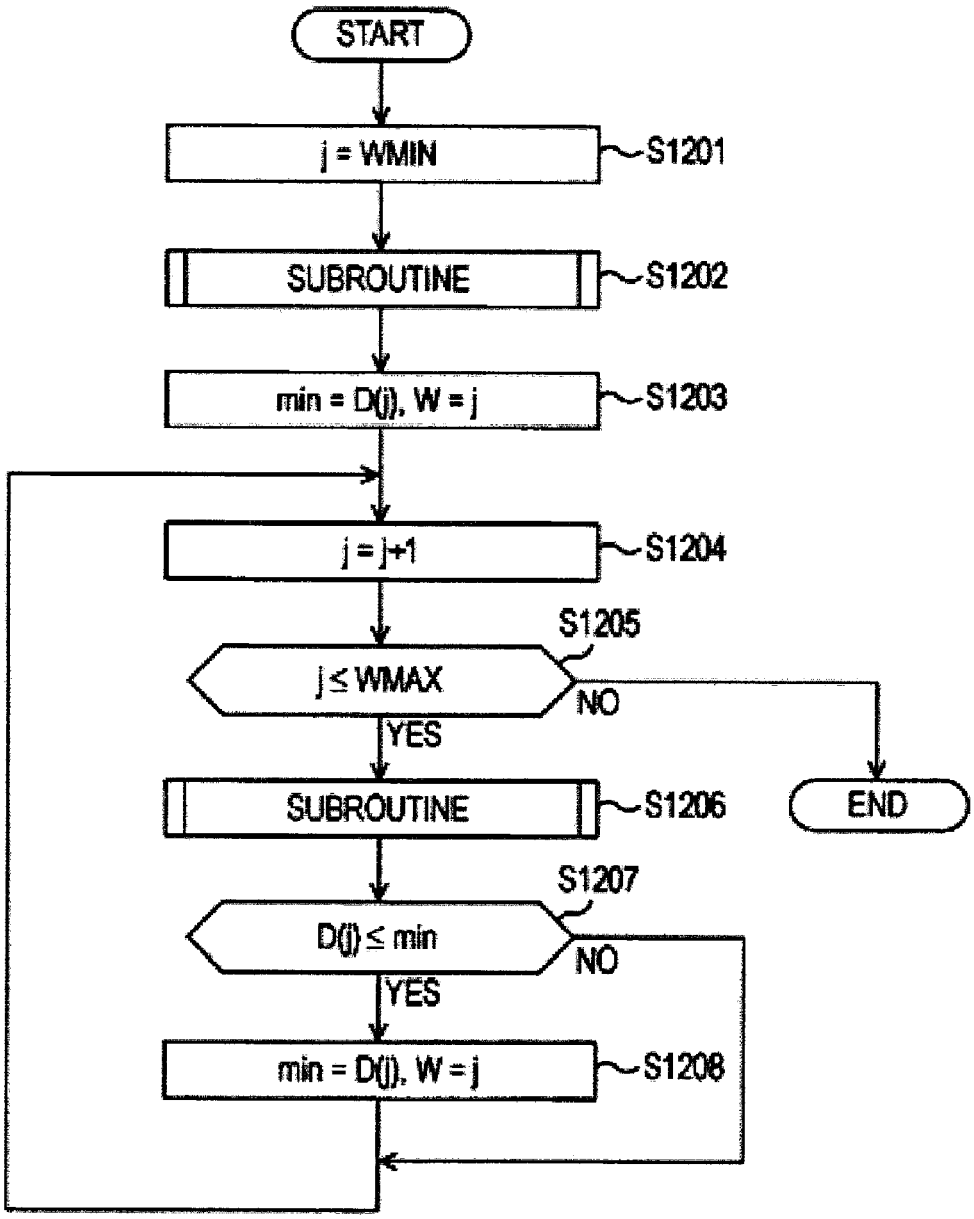
FIG. 21 is a flowchart showing a flow of a process performed by a known similar waveform length extracting unit.
Figure 22:
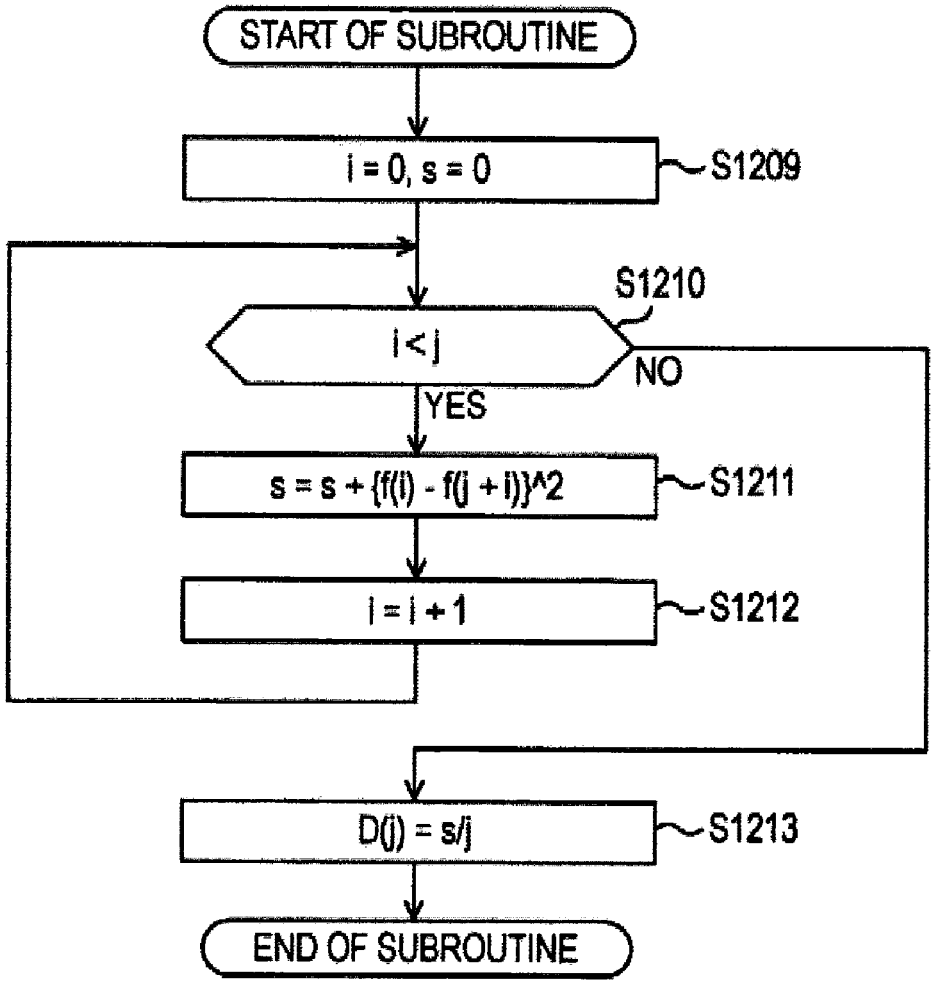
FIG. 22 is a flowchart showing a process of a subroutine of a known similar waveform length extracting process.

FIG. 12 is a flowchart of a subroutine of the similar waveform length extracting process corresponding to the signal comparison length LEN represented by Equations (27) and (28). At STEP S609, an index i and a variable s are reset to 0. At STEP S610, whether or not the index i is smaller than a value LEN is determined. If the index i is smaller than the value LEN, the process proceeds to STEP S611. If the index i is not smaller than the value LEN, the process proceeds to STEP S613. At STEP S611, a square of a difference between the input audio signals is determined, and is added to the variable s. At STEP S612, the index i is incremented by 1, and the process returns to STEP S610. At STEP S613, the value of the function D(j) is set to a value obtained by dividing the variable s by the value LEN, and the subroutine is terminated.

As described above, noises that caused in expanded or compressed signals can be further suppressed by automatically setting the length of the signal comparison intervals suitably if the input audio signal is a voice signal or an acoustic signal.

Although extension of the length of the signal comparison intervals in the future direction (to the right in the figures) has been described, the intervals may be extended not only in the future direction but also in both future and past directions and in the past direction. In addition, the origin of the similar waveform extraction is set to the point P0 shown in FIG. 2, for example. However, the origin is not limited to this particular example, and the origin may be changed to the middle of the interval. In such a case, the signal comparison length can be extended in the future direction, in the past direction, and in both directions. In addition, the sum of squares of the differences is used as the definition example of the function D(j). The function D(j) may be defined as the sum of absolute values of the differences. That is, the function D(j) may be defined in any manner as long as the similarity of two waveforms can be measured.

Furthermore, in the above description, the known similar waveform length extracting method in known PICOLA is replaced. Application of the method according to the embodiments of the present invention is not limited to this particular example, and can be applied to time-scale speech speed converting algorithms involving a similar waveform length extracting process, such as other OLA (OverLap and Add) algorithms. In addition, when a sampling frequency is kept constant, PICOLA converts a speech speed, whereas, when the sampling frequency changes in accordance with a change in the number of samples, PICOLA shifts the pitch. Thus, the embodiments of the present invention can be applied not only to the speech speed conversion but also to the pitch shifting.

It should be understood by those skilled in the art that various modifications, combinations, sub-combinations and alterations may occur depending on design requirements and other factors insofar as they are within the scope of the appended claims or the equivalents thereof.

What is claimed is:

1. A computer-implemented method, comprising:
receiving an audio signal;
computing, using a processing unit, a signal comparison length for a first comparison interval and a second comparison interval of the audio signal, wherein the computing comprises:
determining a type of audio content associated with the audio signal, based on at least a source of the audio signal, the audio signal comprising an acoustic signal or a voice signal; and
computing the signal comparison length based on at least the audio content type, the signal comparison length being equal to or larger than a minimum waveform detection length;
identifying, a first waveform within the first comparison interval and a second waveform within the second comparison interval;
determining an interval length associated with the first and second waveforms based on a change in an amount of shift between the first comparison interval and the second comparison interval, wherein the shift amount does not exceed the signal comparison length; and
expanding or compressing the received audio signal in the time domain, based on the interval length.

2. The method of claim 1, further comprising receiving information identifying the source of the audio signal.

3. The method of claim 1, wherein the signal comparison length is equivalent to an average of the shift amount and the minimum waveform detection length.

4. The method of claim 1, wherein:
the method further comprises determining a likelihood of that the audio signal comprises acoustic content; and
the computing comprises computing the signal comparison length of based on at least the likelihood.

5. The method of claim 1, further comprising
computing, for a plurality of signal comparison lengths, corresponding values of an indicia of similarity for pairs of waveforms associated with the first and second comparison intervals;
determining a minimum of the values of the similarity indicia; and
identifying the pair of waveforms associated with the minimum value and the first and second waveforms.

6. The method of claim 1, further comprises transmitting the expanded or compressed audio signal to a recipient.

7. The method of claim 1, wherein the signal comparison length is larger than the interval length associated with the first and second waveforms.

8. The method of claim 1, wherein the signal comparison length corresponds to a maximum waveform detection length.

9. An apparatus, comprising:
a receiving unit configured to receive an audio signal;
a processing unit coupled to the receiving unit and configured to:
compute a signal comparison length for a first comparison interval and a second comparison interval of the audio signal, wherein the processing unit is further configured to:
determine a type of audio content associated with the audio signal, based on at least a source of the audio signal, the audio signal comprising an acoustic signal or a voice signal; and
compute the signal comparison length based on at least the audio content type, the signal comparison length being equal to or larger than a minimum waveform detection length;
identify a first waveform within the first comparison interval and a second waveform within the second comparison interval; and
determine an interval length associated with the first and second waveforms based on a change in an amount of shift between the first comparison interval and the second comparison interval, wherein the shift amount does not exceed the signal comparison length; and
a unit coupled to the receiving unit and configured to expand or compress the received audio signal in the time domain, based on the interval length.

10. The apparatus of claim 9, wherein the receiving unit is further configured to receive information identifying the source of the audio signal.

11. The apparatus of claim 9, wherein the signal comparison length is equivalent to an average of the shift amount and the minimum waveform detection length.

12. The apparatus of claim 9, wherein:
the apparatus further comprises a unit configured to determine a likelihood that the audio signal comprises acoustic content; and
the processing unit is further configured to compute the signal comparison length based on the likelihood.

13. The apparatus of claim 9, further comprising:
a unit configured to compute, for a plurality of signal comparison lengths, corresponding values of an indicia of similarity for pairs of waveforms associated with the first and second comparison intervals; and
a unit configured to determine a minimum of the values of the similarity indicia,
wherein the identifying unit further identifies the pair of waveforms associated with the minimum value and the first and second waveforms.

14. The apparatus of claim 9, further comprising a transmission unit configured to transmit the expanded or compressed audio signal to a recipient.

15. The apparatus of claim 9, wherein the signal comparison length is larger than the interval length associated with the first and second waveforms.

16. The apparatus of claim 9, wherein the signal comparison length corresponds to a maximum waveform detection length.

* * * * *